US006773098B2

(12) United States Patent
Corby et al.

(10) Patent No.: US 6,773,098 B2
(45) Date of Patent: Aug. 10, 2004

(54) METHOD OF FILLING INK SUPPLY BAG FOR INK CARTRIDGE

(75) Inventors: Kenneth D. Corby, Rochester, NY (US); Diana C. Petranek, Hilton, NY (US); Mark D. Perkins, Wayland, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/256,039

(22) Filed: Sep. 26, 2002

(65) Prior Publication Data

US 2004/0061749 A1 Apr. 1, 2004

(51) Int. Cl.[7] ..... M41J 2/175
(52) U.S. Cl. ..... 347/85; 347/86
(58) Field of Search ..... 347/85, 86; 714/713; 215/2; 53/434, 437, 477, 476, 242

(56) References Cited

U.S. PATENT DOCUMENTS 5,757,390 A * 5/1998 Gragg et al. ..... 347/7
5,950,403 A 9/1999 Yamaguchi et al. ..... 53/434
6,067,906 A * 5/2000 Ryan et al. ..... 101/335
6,289,654 B1 * 9/2001 Yamaguchi et al. ..... 53/434
6,485,137 B2 * 11/2002 Karlinski et al. ..... 347/92

FOREIGN PATENT DOCUMENTS

EP 0 518 237 A2 6/1992

OTHER PUBLICATIONS

European Patent Office–Patent Abstracts of Japan, Publication No 01255548, Publication date Dec. 10, 1989, Title: Inkjet Recording Device.

* cited by examiner

*Primary Examiner*—Anh T. N. Vo
(74) *Attorney, Agent, or Firm*—Roger A. Fields

(57) ABSTRACT

A method of filling an ink supply bag with a liquid ink, includes positioning the bag bottom end down and a top end up; flowing the liquid ink into the bag through an upper portion of the bag to fill the bag to a liquid level below the upper portion; squeezing the bag to raise the liquid level in the bag partway into the upper portion, and shaking the bag to cause any bubbles in the liquid ink in the bag to rise at least substantially to the liquid surface in the upper portion; and sealing the upper portion above and below the liquid level in the upper portion to trap a small quantity of liquid ink that includes the bubbles and a small quantity of air between the respective seals.

6 Claims, 22 Drawing Sheets

METHOD OF FILLING INK SUPPLY BAG FOR INK CARTRIDGE

CROSS REFERENCE TO RELATED APPLICATIONS

Reference is made to commonly assigned, copending applications Ser. No. 09/931,313, entitled INK CARTRIDGE WITH INTERNAL INK BAG AND METHOD OF FILLING and filed Aug. 16, 2001 in the names of Trafton, Farnung, and Petranek, and Ser. No. 10/224,805, entitled METHOD OF FILLING INK SUPPLY BAG FOR INK CARTRIDGE and filed Aug. 21, 2002 in the names of Whitlock and Petranek.

FIELD OF THE INVENTION

The invention relates generally to ink cartridges such as for ink jet printers, and in particular to a method of filling an ink supply bag to be included in an ink cartridge.

BACKGROUND OF THE INVENTION

Prior art U.S. Pat. No. 5,950,403 issued Sep. 14, 1999 discloses a method of filling an ink supply bag with a liquid ink. The filled bag is included in an ink cartridge for an ink jet printer.

According to the disclosed method, the ink supply bag is hung vertically so that a bottom end of the bag faces downward and a top end of the bag faces upward. A liquid ink is flowed into the bag through an opening in the top end and the bag is filled to about 60% of its height, i.e. to a liquid level below an upper portion of the bag. Then, the bag is squeezed below the upper portion to raise the liquid level partway into the upper portion. Next, the upper portion is temporarily sealed below the liquid level in the upper portion so that some liquid ink in the upper portion is above the temporary seal. Then, the bag is released from being squeezed, and any air bubbles in the liquid ink are allowed to aggregate just below the temporary seal in the upper portion. Then, the bag is re-squeezed below the upper portion, but this time more than the first time, and the upper portion is permanently sealed below the temporary seal. This causes a bulge to be formed in the upper portion between the respective seals and traps a small quantity of liquid ink that includes the bubbles in the bulge. Finally, the upper portion is cut along a centerline of the permanent seal, and the remainder of the upper portion above the permanent seal is discarded.

The disclosed method is an attempt to ensure that any air bubbles in the liquid ink are removed. However, since the temporary seal is below the liquid level in the upper portion, the additional liquid above the temporary seal can splash or spill out of the opening in the top end of the bag. Also, the additional liquid above the temporary seal increases the quantity of liquid ink that must be wasted or discarded.

SUMMARY OF THE INVENTION

According to the invention, a method of filling an ink supply bag with a liquid ink, comprises:

positioning the bag bottom end down and a top end up;

flowing the liquid ink into the bag through an upper portion of the bag to fill the bag to a liquid level below the upper portion;

squeezing the bag to raise the liquid level in the bag partway into the upper portion, and shaking the bag to cause any bubbles in the liquid ink in the bag to rise at least substantially to the liquid surface in the upper portion; and sealing the upper portion above and below the liquid level in the upper portion to trap a small quantity of liquid ink that includes the bubbles and a small quantity of air between the respective seals.

Thus, the quantity of liquid ink that cannot be used is reduced as compared to prior art U.S. Pat. No. 5,950,403. Moreover, there can be no spillage of the liquid ink since there is no liquid ink in the upper portion above the uppermost seal as in prior art U.S. Pat. No. 5,950,403.

DETAILED DESCRIPTION OF THE INVENTION

Figure 1:
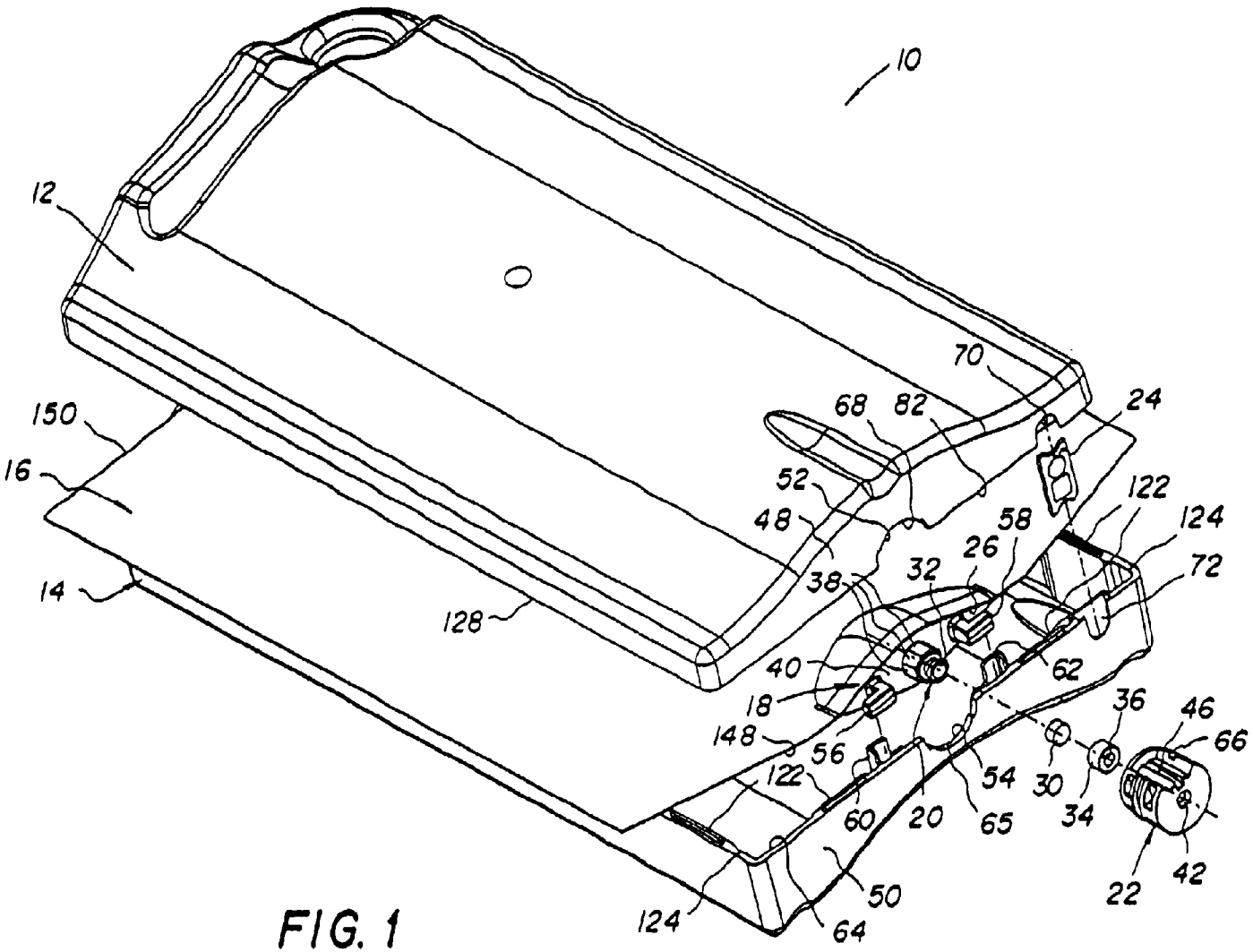
FIG. 1 is an exploded perspective view of an ink cartridge including a pair of housing halves, a fitting including an egress snout for discharging an ink supply from a bag or alternatively for discharging a cleaner supply from the bag, and a collar that mates with the snout in any one of a number of allowable orientations to provide an identification of the ink supply.

Referring now to the drawings, FIGS. 1–22 show an alternative ink/cleaner cartridge 10 for an ink jet printer (not shown).

The cartridge 10 when used as an ink cartridge includes the following components:

- a pair of plastic housing halves 12 and 14 that are connected together to form a cartridge housing;
- a disposable flexible ink supply bag 16;
- a plastic connector-fitting or fitment 18 having an integral ink egress snout 20 for discharging an ink supply from the bag 16;
- a plastic single-part collar 22 for the snout 20, which functions as an ink identifier to identify the ink supply in the bag 16 such as by color or type; and
- a memory chip 24.

Figure 3:
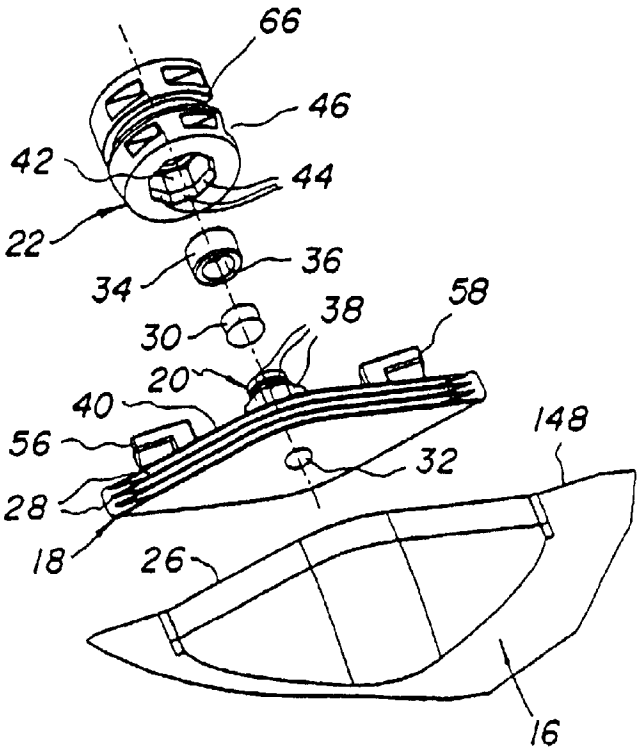
FIGS. 2 and 3 are exploded perspective views of the egress snout and the collar as shown from opposite views.
Figure 2:
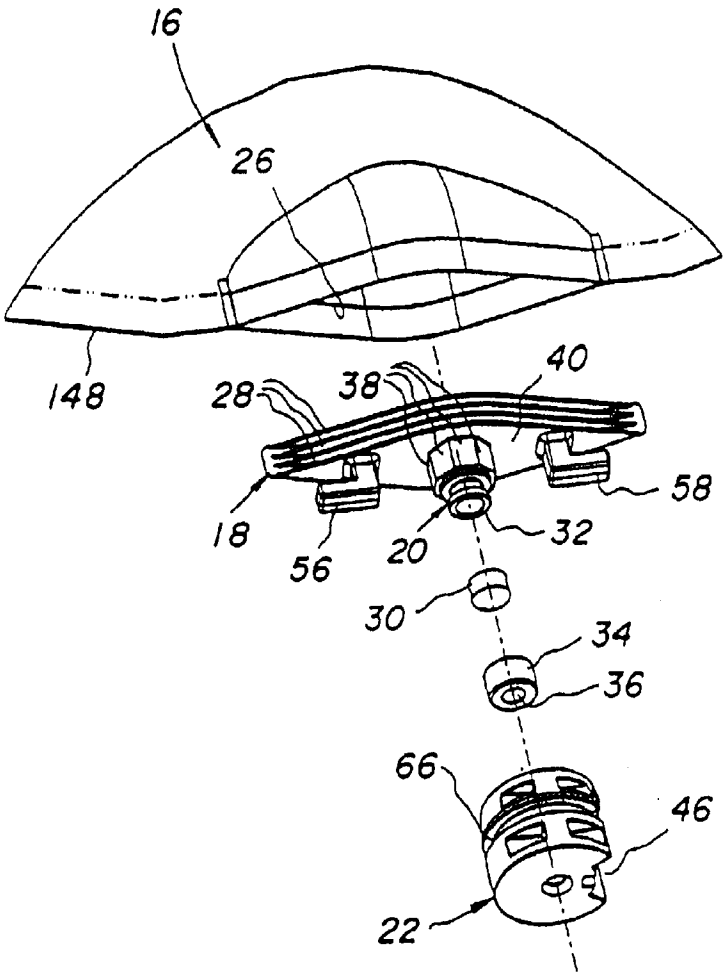

As shown in FIGS. 2 and 3, the fitting 18 is attached via a thermal seal to the bag 16, within an elongate opening 26 in the bag. During the thermal seal of the bag 16 to the fitting 18, a small amount of melted material from the bag flows to between parallel ribs 28 along opposite longitudinal sides of the fitting 18 to provide an essentially leak-proof seal between the bag and the fitting. A rubber septum 30 is tightly inserted into an ink egress opening 32 in the snout 20 to plug the opening. Then, an aluminum or stainless steel cap 34 is press-fitted on the snout 20. The cap 34 partially overlaps the septum 30 to capture the septum, and has a center opening 36 which allows a hollow needle (not shown) to pierce the septum in order to discharge an ink supply from the bag 16 when the cartridge 10 is used in an ink jet printer.

Collar 22 and Snout 20

The snout 20 has eight identical outer peripheral surfaces (sides) or facets 38 that project perpendicular from a longitudinal planar face 40 of the fitting 18 to form an octagon. See FIGS. 2 and 3. In a similar sense, the collar 22 has a center opening 42 that is circumscribed by eight identical inner peripheral surfaces (sides) or facets 44 that form an octagon. This mutual or complementary configuration allows the snout 20 to be received in the center opening 42 only when the collar 22 is in any one of eight allowable angular orientations 0° or 360°, 45°, 90°, 135°, 180°, 225°, 270°, and 315°. Preferably, the eight surfaces 44 of the collar 22 are aligned with the eight surfaces 38 of the snout 20 to position the collar relative to the snout in a selected one of the eight orientations. Then, the collar 22 is mated with the snout 20 in the selected orientation. Respective contact between the eight surfaces 38 and the eight surfaces 44 prevents the collar 22 from being rotated about the snout 22 and thus serves to fix the collar in the selected orientation. The selected orientation provides a visible indication that serves to identify the ink supply in the bag 16 such as by color or type.

The collar 22 has a key slot or keyway 46 that is angular positioned in accordance with the selected orientation of the collar. The hollow needle (not shown) for piercing the septum 30 in order to discharge an ink supply from the bag 16 when the cartridge 10 is used in an ink jet printer, is mounted on a key assembly (not shown) having a key tab intended to be received in the key slot 46.

The particular orientation of the key assembly must match the selected orientation of the collar 22 in order for the key tab to be received in the key slot 46. The number of the surfaces 38 of the snout 20 and the number of the surfaces 44 of the collar 22, need not each be eight (although they must be the same number). Preferably, the number of the surfaces 38 of the snout 20 and the number of the surfaces 44 of the collar 22 fall within the range 4–12. All that is necessary is that the number of the surfaces 38 of the snout 20 and the number of the surfaces 44 of the collar 22 form similar complementary polygons that permit the collar 22 to mate with the snout 20.

L-shaped Engageable-disengageable Members 56, 58, 60 62

Figure 4:
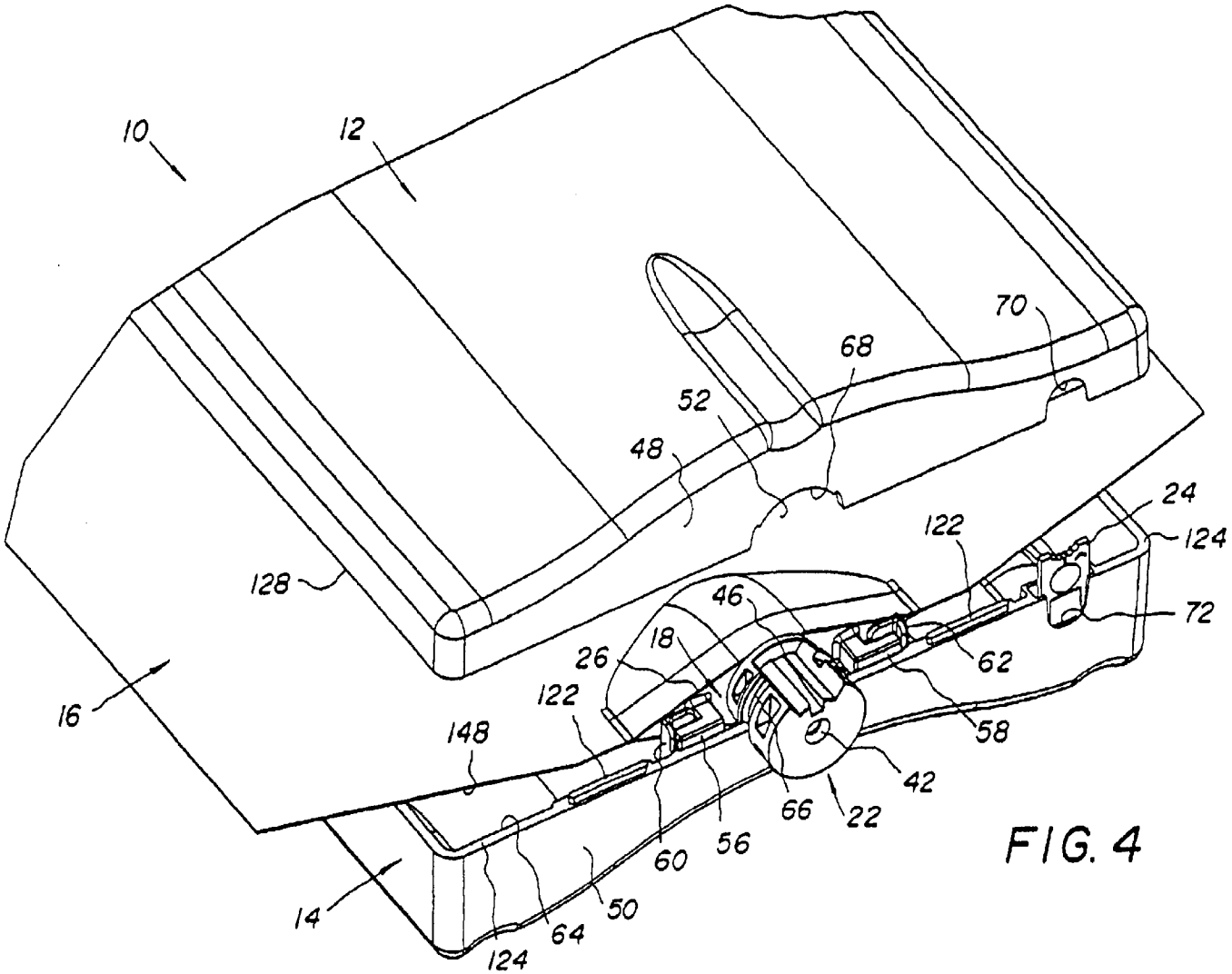
FIG. 4 is a perspective view similar to FIG. 1, except that the cartridge is shown partially assembled.
Figure 6:
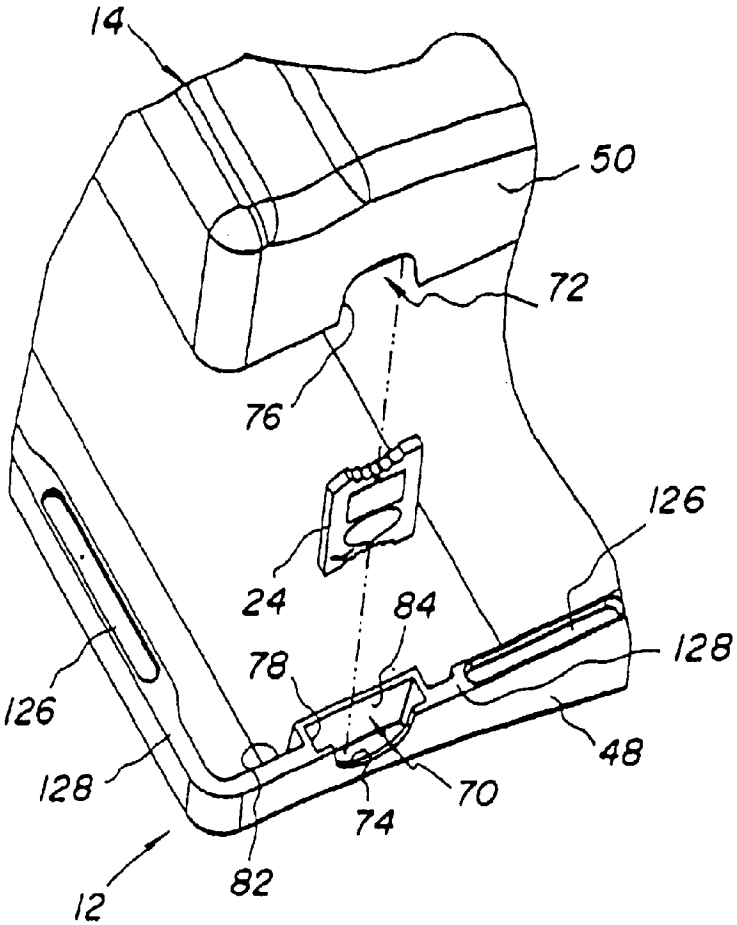
FIGS. 5 and 6 are exploded perspective views of a memory chip shown being inserted into a pocket in the housing halves.
Figure 5:
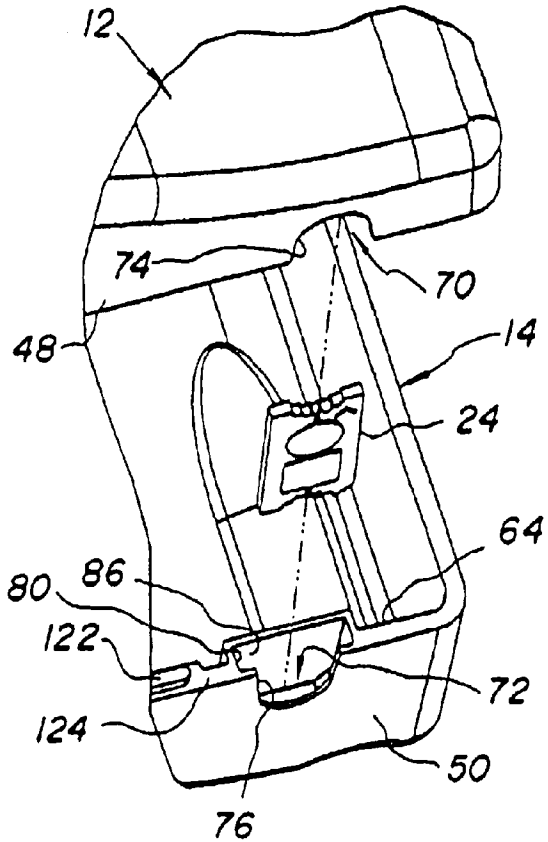

The housing halves 12 and 14 at respective bottom wall portions 48 and 50 have opening halves 52 and 54 that form a single bottom opening when the housing halves are connected together. See FIGS. 1 and 4. The fitting 18 has a pair of L-shaped engageable-disenageable members or tabs 56 and 58 that project from respective areas of the face 40 (of the fitting) which are spaced from the snout 20. In a similar sense, a pair of L-shaped engageable-disengageable members or tabs 60 and 62 project from an inner side 64 of the wall portion 50 and are spaced from the opening half 52. The L-shaped engageable-disengageable members 56 and 58 extend in opposite directions as do the L-shaped engageable-disengageable members 60 and 62. This complementary arrangement or mutual configuration permits the L-shaped member 56 to engage the L-shaped member 60 and the L-shaped member 58 to engage the L-shaped member 62 when the bag 16 is placed on the housing half 14. The bag 16 is thus secured in place. At the same time as shown in FIG. 4 an edge 65 of the opening half 54 is received in an outer peripheral groove 66 in the collar 22 to support the collar. Then, when the housing half 12 is connected to the housing half 14, an edge 68 of the opening half 52 is received in the groove 66.

When the bag 16 is emptied, it is possible to remove the bag (with the fitting 18) from the cartridge 10. If the housing half 12 is disconnected from the housing half 14, the L-shaped engageable-disengageable members 56 and 58 are disengaged from the L-shaped engageable-disengageable members 60 and 62. Also, the collar 22 can be removed from the snout 20.

Other L-shaped engageable-disengageable members can be provided on the fitting 18 and the housing half 14 in addition to the L-shaped engageable-disengageable members 56 and 58 and the L-shaped engageable-disengageable members 60 and 62. Also, it is not necessary that these engageable-disengageable members be L-shaped. A number of known engagements or interlocks can be used instead, such as pins in holes, etc.

Pocket for Memory Chip 24

As shown in FIGS. 1 and 4–6, the housing halves 12 and 14 at bottom wall portions 48 and 50 have respective pocket portions 70 and 72 which include slightly smaller and larger wall opening portions 74 and 76 and sleeve or channel portions 78 and 80. Moreover, the bottom wall portion 48 at an inner side 82 and the bottom wall portion 50 at the inner side 64 have respective ink blocking shield segments 84 and 86 that project inwardly of the housing halves 12 and 14 from the inner sides. See FIGS. 5 and 6. The ink blocking shield segment 84 is an integral extension of the inner side 82 and extends across the wall opening portion 74, and the ink blocking shield segment 86 is an integral extension of the inner side 64 and extends across the wall opening portion 76. This is to isolate or seal the wall opening portions 74 and 76 from the interiors of the housing halves 12 and 14. The wall opening portions 74 and 76 are necessary to permit electrical contact to be made with the memory chip 24 when the cartridge 10 is used in an ink jet printer.

When the housing halves 12 and 14 are connected together, the memory chip 24 is peripheral-edge supported in the channel portions 78 and 80 to hold the memory chip in the wall opening portions 74 and 76. Also, the pocket portions 70 and 72 combine to form a single pocket including the wall opening portions 74 and 76 combining to form a single wall opening, and the ink blocking shield segments 84 and 86 abut end-to-end to seal the single wall opening. The ink supply bag 16, which is between the housing halves 12 and 14, might per chance leak ink. However, the ink blocking shield segments 84 and 86 which are then abutted end-to-end prevent any ink from entering the wall opening portions 74 and 76 and contaminating the memory chip 24.

Optional Stakes for Fitting 18

Figure 7:
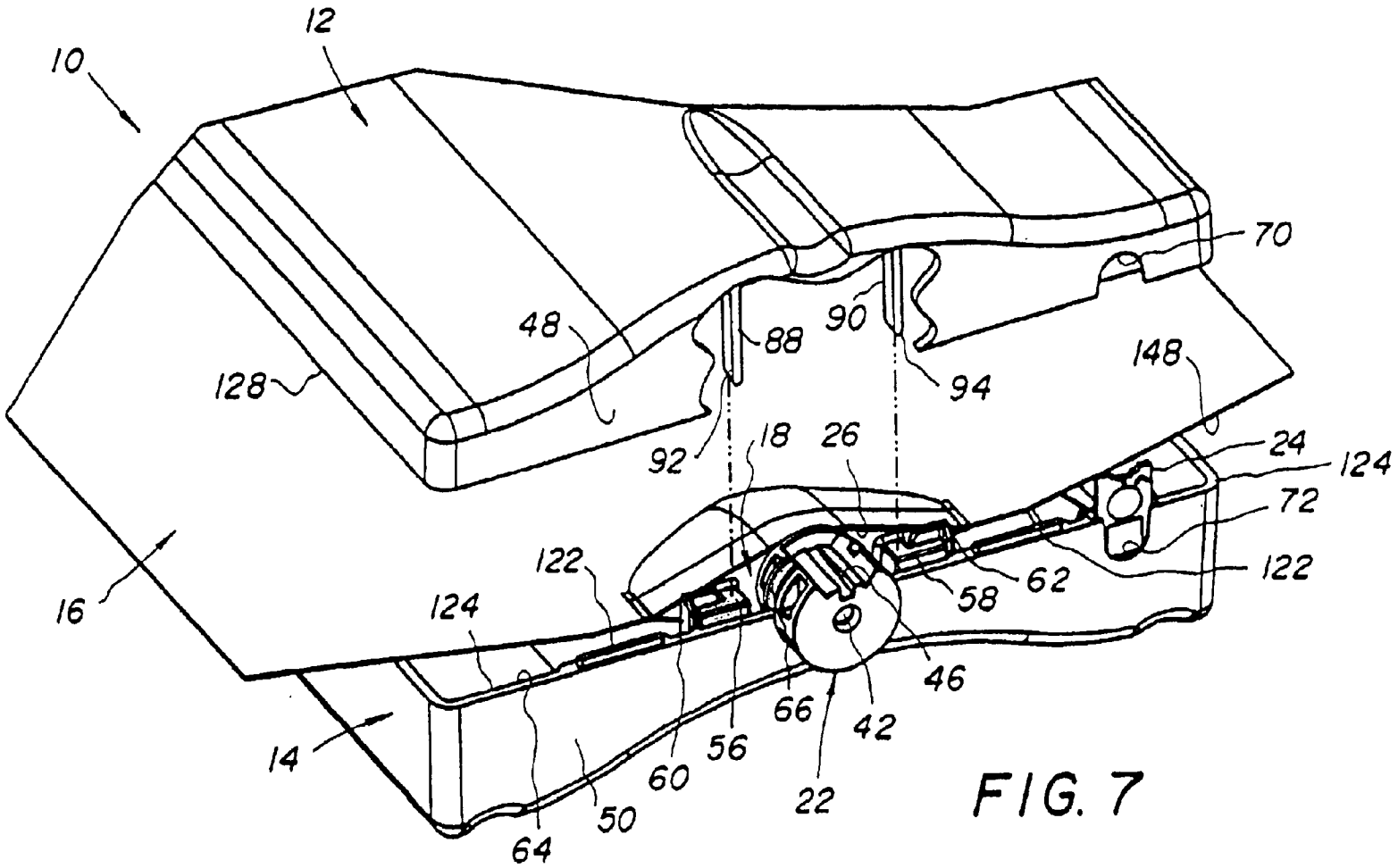
FIG. 7 is a perspective view similar to FIG. 4, except that one of the housing halves is shown partially cut away to reveal stakes that are adhered to the fitting.

As shown in FIG. 7, the housing half 12 has at least two interior stakes 88 and 90 that project from the housing half and are parallel to the bottom wall portion 48 of the housing half. When the housing halves 12 and 14 connected together, respective tips 92 and 94 of the stakes 88 and 90 are melted preferably onto the L-shaped engageable-disengageable members 56 and 58 of the fitting 18 to adhere the stakes to those L-shaped members. The stakes 88 and 90 thus hold the L-shaped engageable-disengageable members 56 and 58 of the fitting 18 fast to the housing half 12, and can be separated from those L-shaped members only by breaking the connection at the melted tips 92 and 94 (or by breaking the stakes and/or the L-shaped members). This positively ensures that the fitting 18 cannot shift, however slightly, when the L-shaped engageable-disengageable member 56 is engaged with the L-shaped engageable-disengageable member 60 and the L-shaped engageable-disengageable member 58 is engaged with the L-shaped engageable-disengageable member 62 as shown in FIGS. 4 and 7. Also, the fitting 18 cannot be removed from the housing half 12 without forcibly separating the stakes 88 and 90 from the L-shaped engageable-disengageable members 56 and 58.

Alternatively, the tips 92 and 94 of the stakes 88 and 90 can be melted onto the L-shaped engageable members 60 and 62 of the housing half 14 to hold those L-shaped members fast to the housing half 12.

Alternatively, the tips 92 and 94 of the stakes 88 and 90 can be melted onto both the L-shaped engageable members 56 and 58 of the fitting 18 and the L-shaped engageable members 60 and 62 of the housing half 14.

The tips 92 and 94 of the stakes 88 and 90 can be melted onto the L-shaped engageable members 56 and 58 of the fitting 18 and/or the L-shaped engageable members 60 and 62 of the housing half 14 via a conventional vibration weld that melts the tips.

Cap 96

FIGS. 8–12 show the cartridge 10 when used as a cleaner cartridge instead of an ink cartridge. In this instance, the bag 16 is a cleaner supply bag instead of an ink supply bag, and a cap 96 is mated with the snout 20 in place of the collar 22. The cap 96 must be removed from the snout 20 to allow a hollow needle (not shown) to pierce the septum 30 in order to discharge a cleaner material, e.g. a known cleaner solution, from the bag 16. The cleaner material is intended to be applied in an ink jet printer instead of an ink supply, to clean the ink jet printer of any ink residue.

The cap 96 has the same diameter as the collar 22 and, like the center opening 42 in the collar, it has a center opening 98 for receiving the snout 20. See FIGS. 3 and 10. Also, like the outer peripheral groove 66 in the collar 22, the cap 96 has an outer peripheral groove 100 for receiving the edge 65 of the opening half 54 in the bottom wall portion 50 of the housing half 14 and for receiving the edge 68 of the opening half 52 in the bottom wall portion 48 of the housing half 12. See FIGS. 1, 4 and 8, 11.

Figure 8:
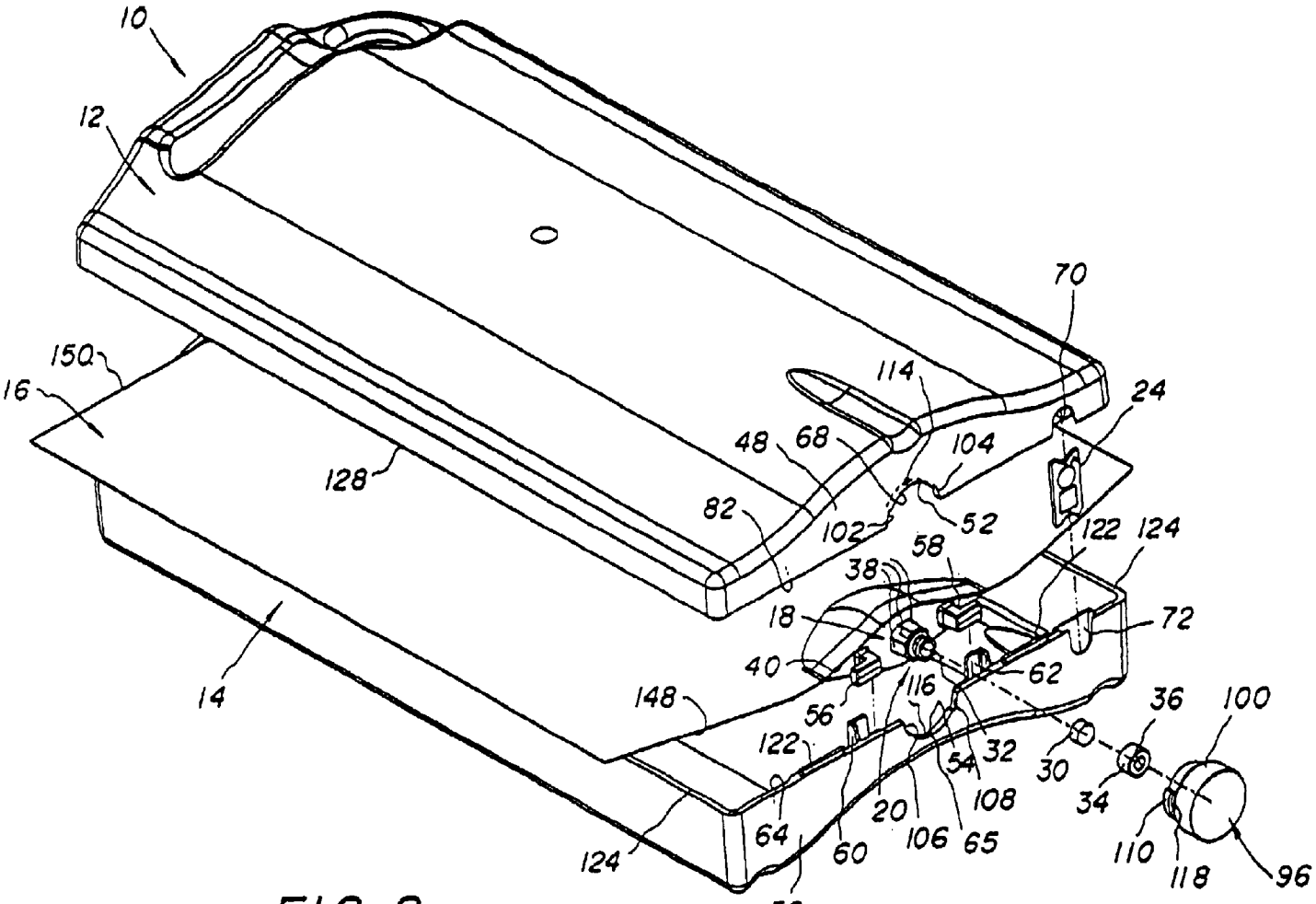
FIG. 8 is a perspective view similar to FIG. 1, except that a cap is mated with the snout in place of the collar when the cleaner supply rather than the ink supply is stored in the bag.
Figure 10:
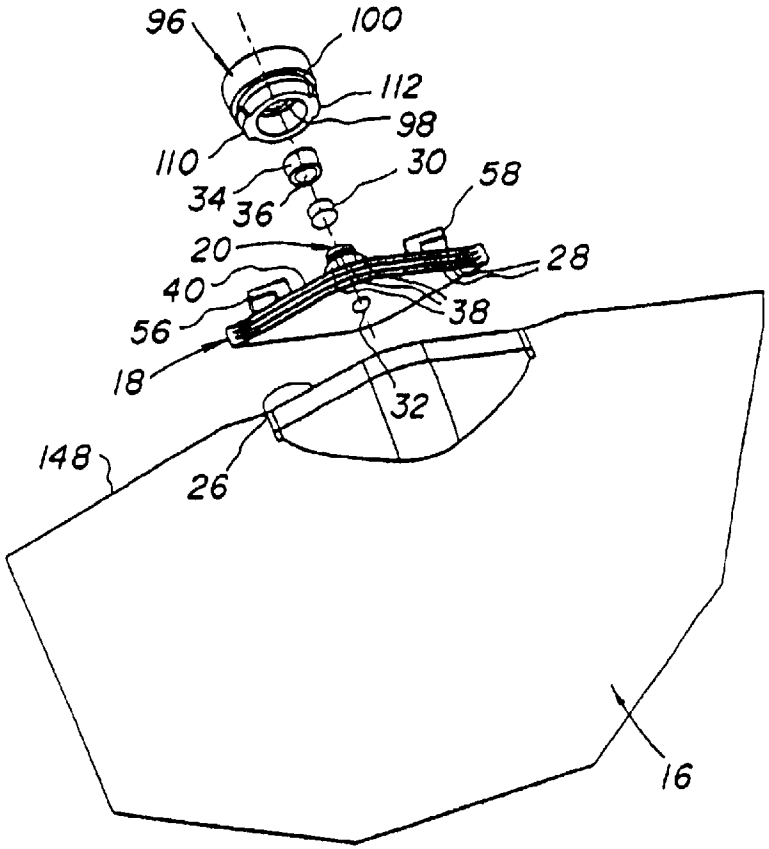
FIGS. 9, 10 and 11 are perspective views similar to FIGS. 2, 3 and 4, except that the cap is shown rather than the collar.
Figure 9:
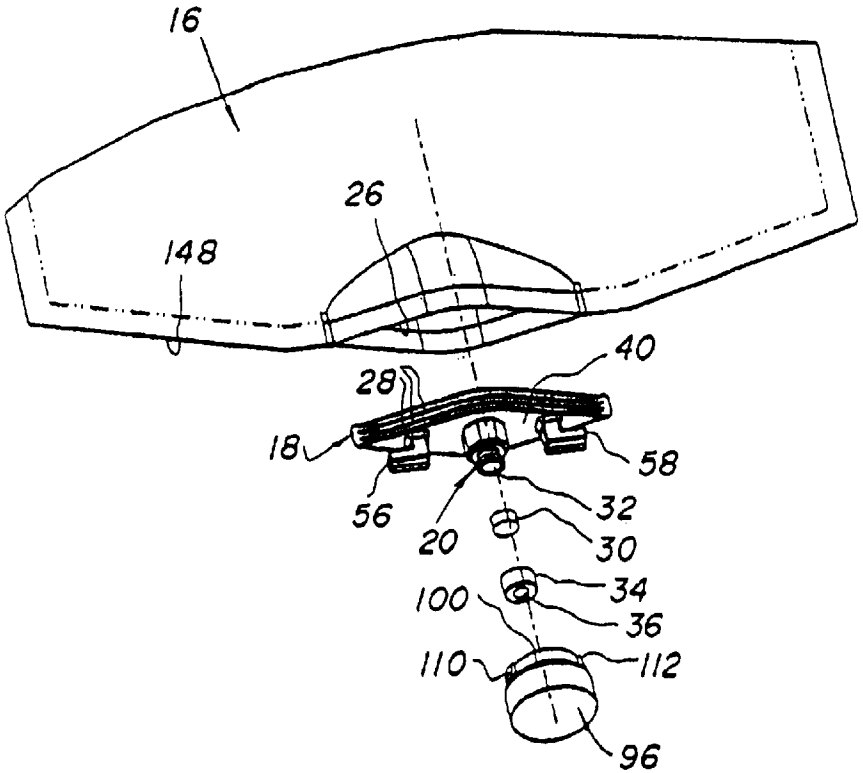
Figure 11:
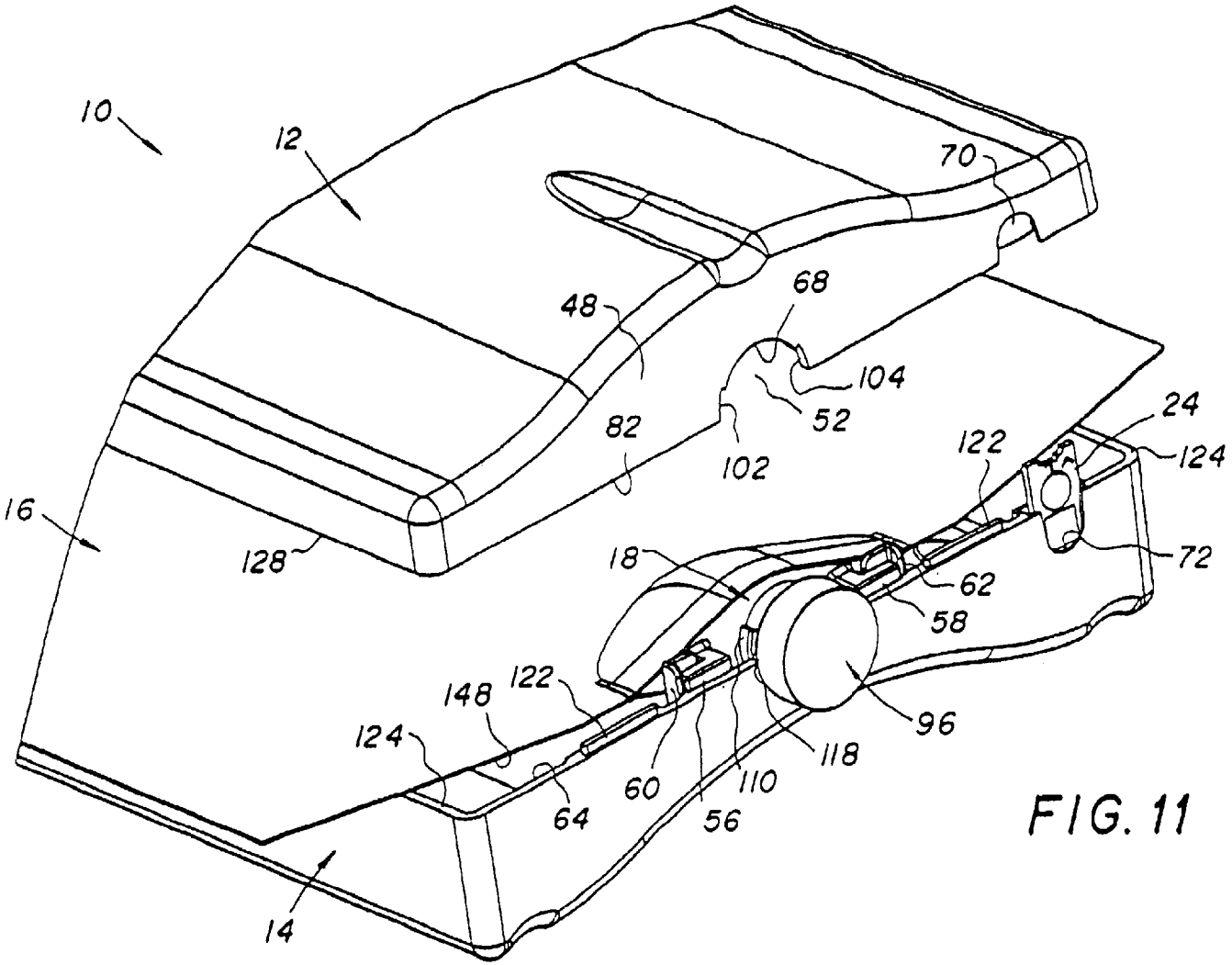

As shown in FIG. 8, the bottom wall portion 48 of the housing half 12 has a pair of clearance recesses 102 and 104 at the edge 68 of the opening half 52, and the bottom wall portion 50 of the housing half 14 has a pair of clearance recesses 106 and 108 at the edge 65 of the opening half 54. The four clearance recesses 102, 104, 106 and 108 permit a pair of lugs 110 and 112 on the cap 96 to be admitted through the opening halves 52 and 54. Then, when the cap 96 is rotated on the snout 20, the lugs 110 and 112 engage with the bottom wall portions 48 and 50 at their inner sides 82 and 64.

Figure 12:
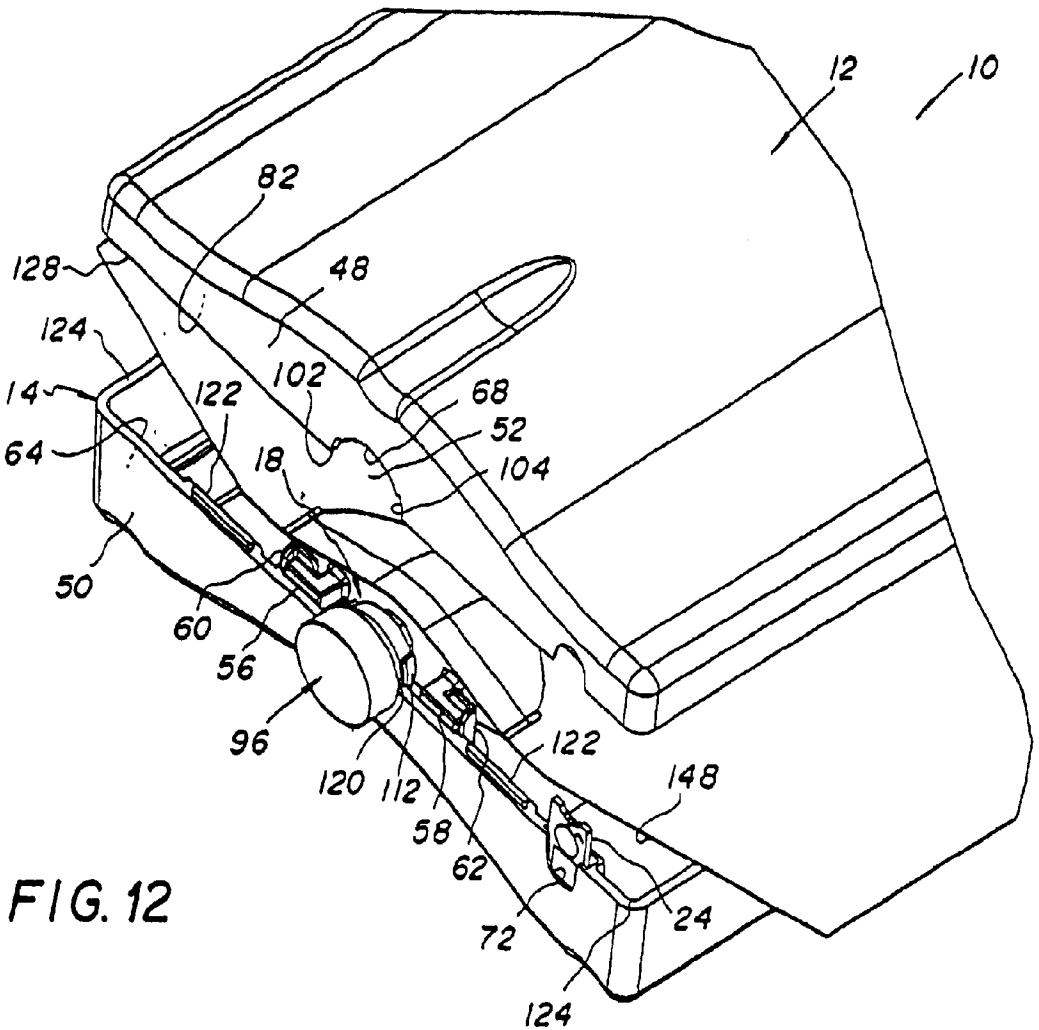
FIG. 12 is a perspective view similar to FIG. 11, but as shown from an opposite view.
Figure 13:
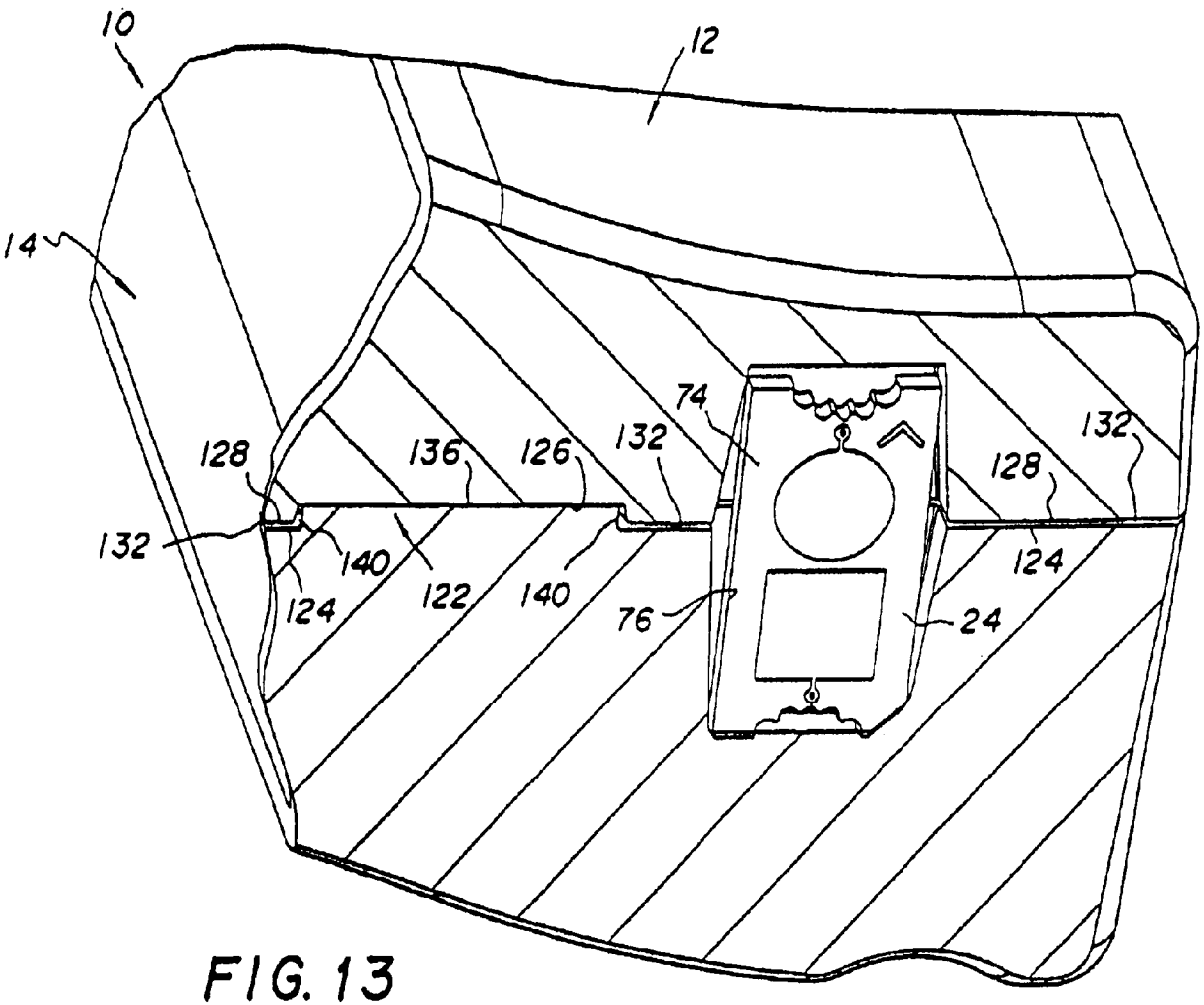
FIG. 13 is a section view of the housing halves, showing how protuberances on one of the housing halves are received within respective cavities in the other housing half in order to be welded to the other housing half.

As shown in FIGS. 8 and 12, the inner side 82 of the bottom wall portion 48 has a cavity 114 adjacent the edge 68 of the opening half 52, and the inner side 64 of the bottom wall portion 50 has a cavity 116 adjacent the edge 65 of the opening half 54. The cavities 114 and 116 receive respective protuberances or bumps 118 and 120 adjacent the lugs 110 and 112 on the cap 96 when the cap is rotated on the snout 20 (with the lugs against the inner sides 82 and 64 of the bottom wall portions 48 and 50). The protuberances 118 and 120 in combination with the cavities 114 and 116 serve to prevent unintended rotation of the cap 96.

Connecting Housing Halves 12 and 14 Together

As shown in FIGS. 1, 5, 6 and 13–15, a number of identical protuberances or tabs 122 project from an edge 124 along the housing half 14 and are to be received in respective cavities 126 in an edge 128 along the housing half 12.

Figure 15:
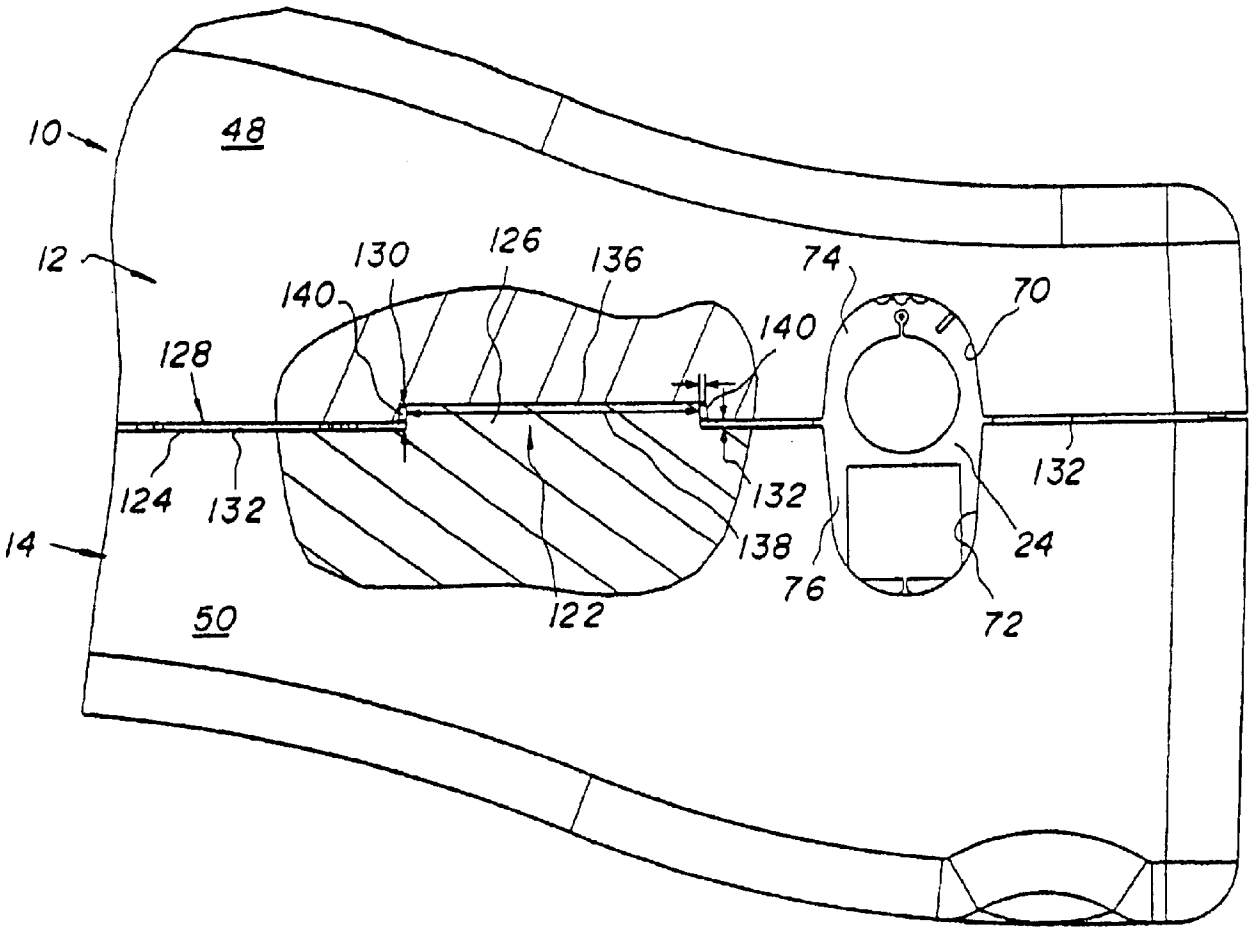
FIG. 15 is a section view similar to FIG. 13, showing arrows to indicate various dimensions.
Figure 16:
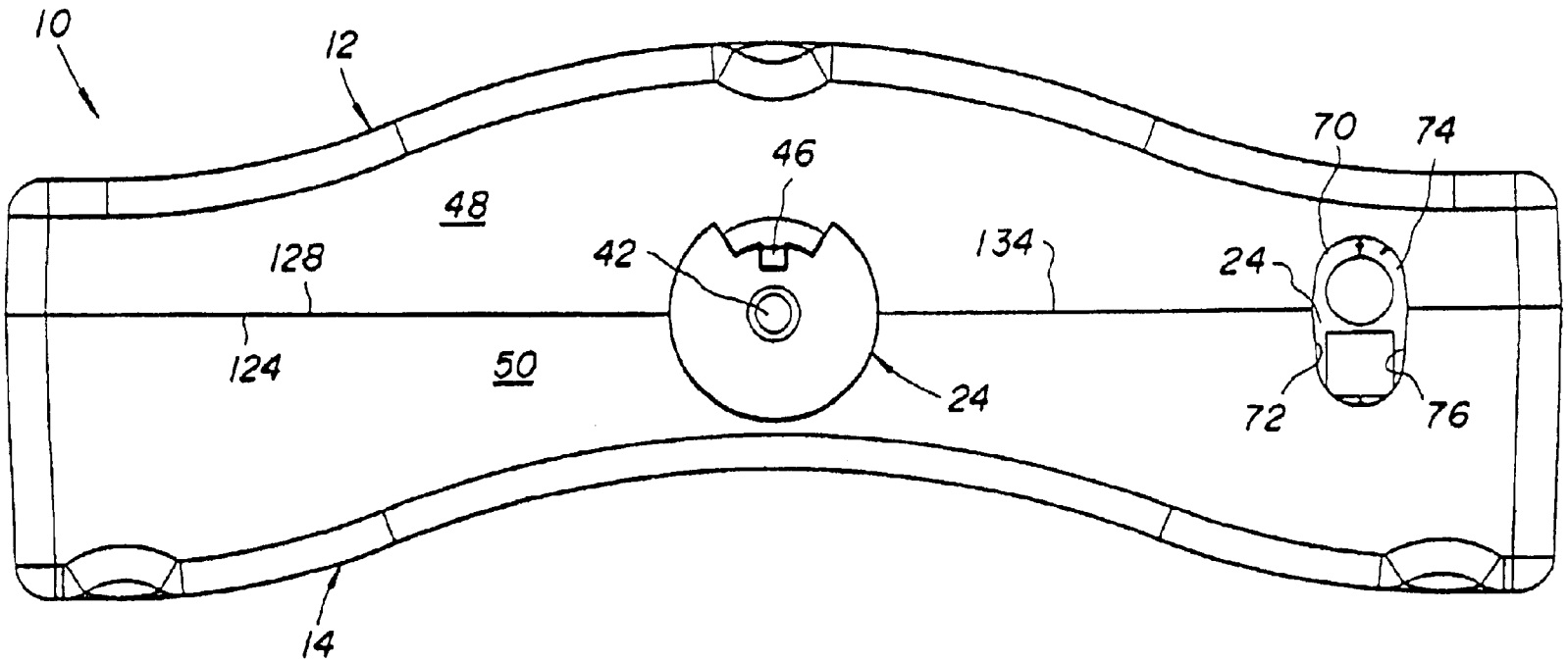
FIG. 16 is an end view of the housing halves connected together.

The protuberances 122 each have an original length 130 in FIG. 15, preferably about 1.38 mm, that is about 0.38 mm greater than the depth of each cavity 126 (the depth of each cavity is about 1.00 mm). Consequently, when the protuberances 122 are received in the cavities 126, the edges 124 and 128 of the housing halves 14 and 12 are separated by a space or gap 132 in FIG. 15 which is about 0.38 mm. This prevents the edges 124 and 128 from abutting to form a seam 134 between the housing halves 14 and 12.

Figure 14:
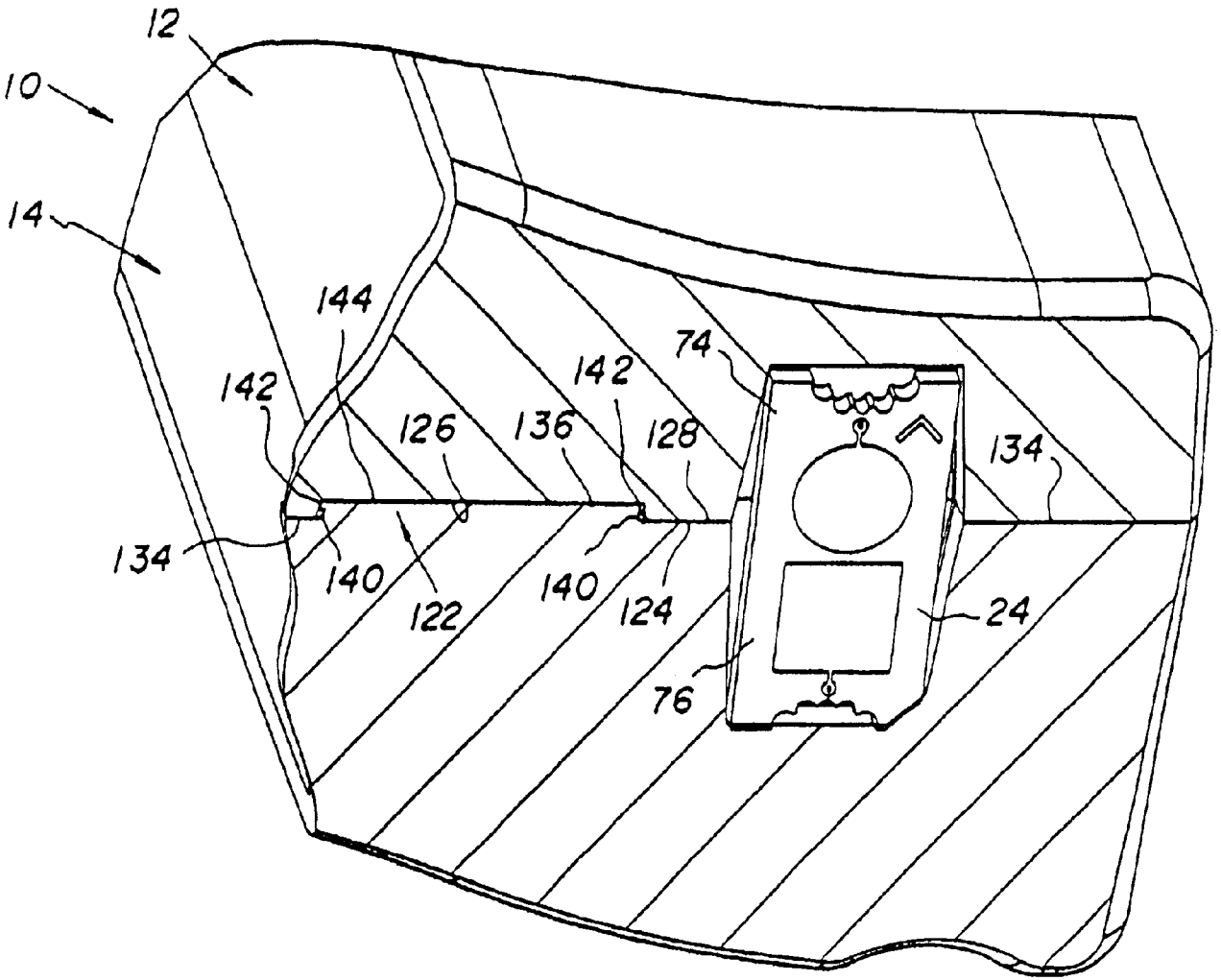
FIG. 14 is a section view of the housing halves, showing a protuberance welded to the other housing half.

To connect the housing halves 12 and 14 together, the protuberances 122 are welded at their tips 136 (within the cavities 126) to the housing half 12, preferably by a known vibration welding process, as shown in FIG. 14. The heat generated by the welding melts the tips 136 to reduce the length 130 of the protuberances 122 from about 1.38 mm to about 1.00 mm, i.e. about 0.38 mm. This eliminates the spaces 132, which permits the edges 124 and 128 to abut to form the seam 134 between the housing halves 14 and 12. See FIGS. 14 and 16.

As shown in FIG. 15, each protuberance 122 has a width 138, preferably about 16.98 mm. Clearance spaces 140 of at least 0.33 mm exist between each side of a protuberance 122 and respective sides of a cavity 126. Thus, the width of a cavity 126 is at least 17.31 mm.

When the protuberances 122 are welded at their tips 136 (within the cavities 126) to the housing half 12, a flash 142 is formed at respective welds 144 between the tips and the housing half 12. The flash 142 spreads from each weld 144 into the clearance spaces 140. As shown in FIG. 14, the flash 142 only partially fills the clearance spaces 140. Thus, the protuberance 122 and the cavities 126 are mutually dimensioned to restrict the flash 142 substantially to within the cavities. This prevents the flash 142 from spreading between the edges 124 and 128 of the housing halves 14 and 12, since if the flash was to spread between the edges it could interfere with their abutting to form the seam 134. Also, it prevents the flash 142 from bulging outward from the seam 134 including in the vicinity of the wall opening portions 74 and 76 (that combine to form a single wall opening for permitting electrical contact to be made with the memory chip 24), since if the flash was to bulge outward of the seam in the vicinity of the wall opening portions it might present an obstacle to making electrical contact with the memory chip.

One Method of Filling Bag 16

One method of filling the bag 16 with the ink supply, preferably a known liquid ink 146, is as follows.

Figure 17:
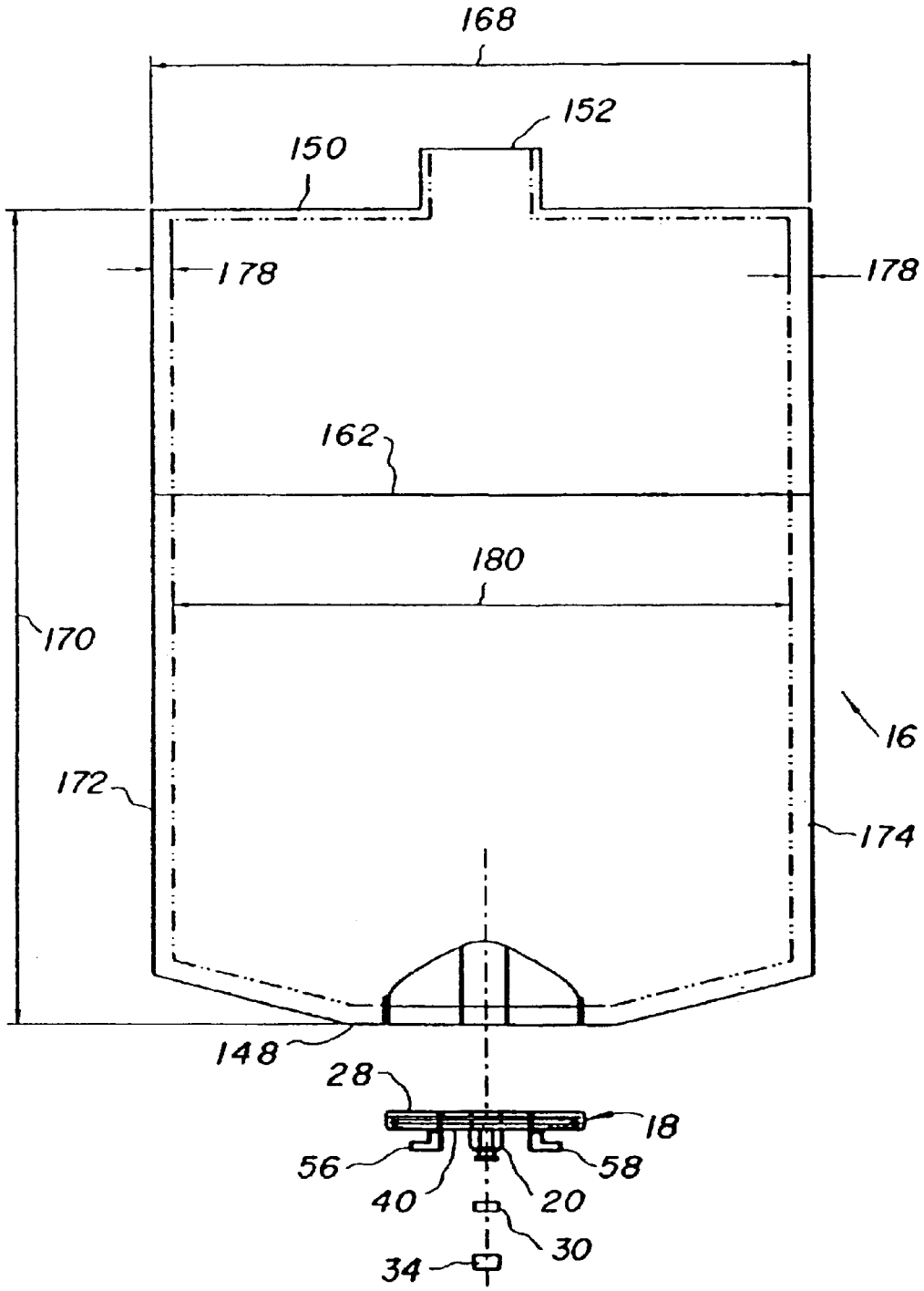
FIG. 17 is a plan view of the bag when empty and shown bottom end down and top end up.

In FIG. 17, the bag 16 is positioned vertically or erect with a bottom end 148 down and a top end 150 up. An intake/exhaust port 152 that is attached to the bag 16 at the top end 150 faces upward. Conversely, the fitting 18 that is attached to the bag 16, including the snout 20 with the septum 30 and the cap 34, faces downward.

Figure 18:
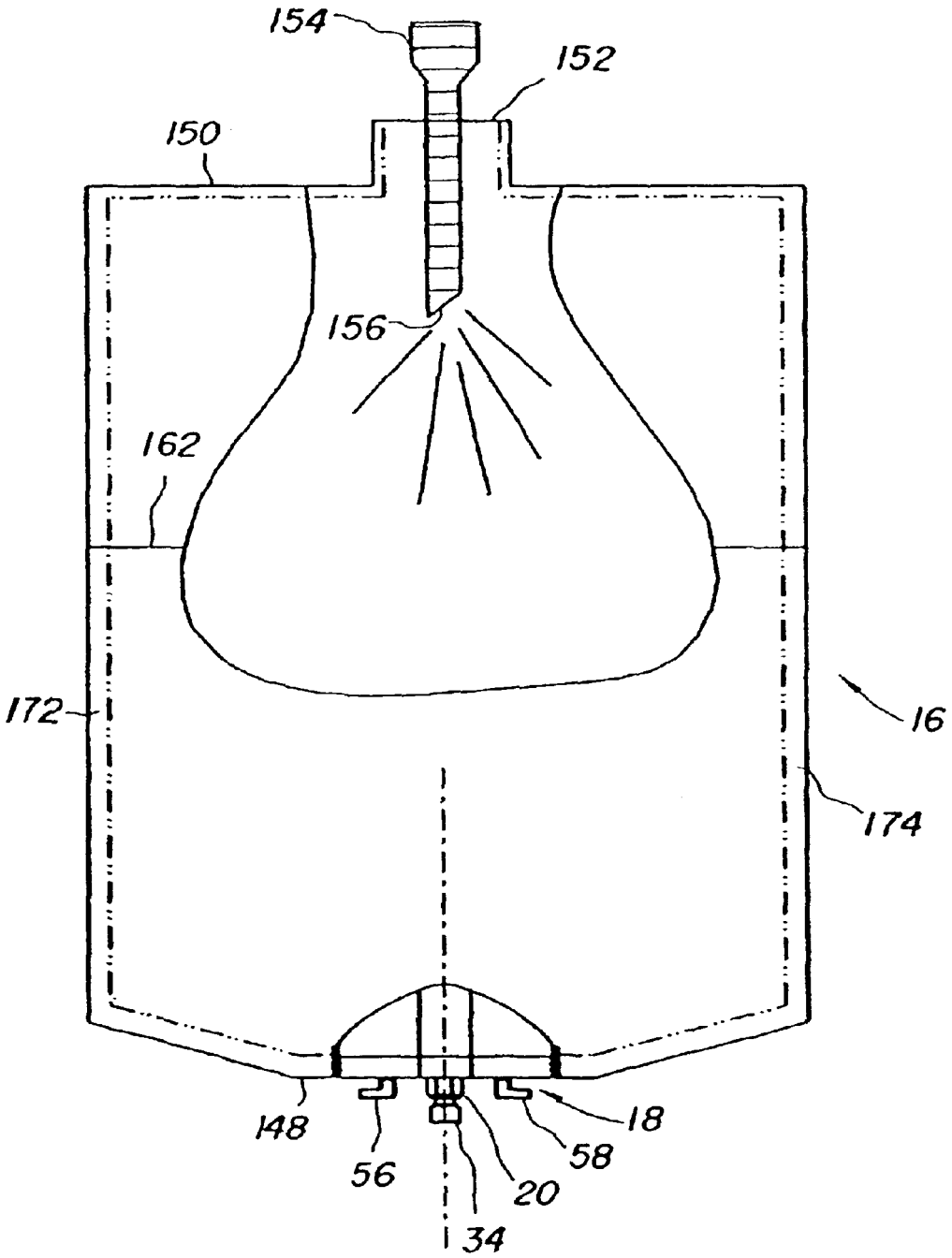
FIG. 18 is a plan view similar to FIG. 17, showing an air delivery nozzle blowing air into the bag to expand the bag substantially to its full volume.

In FIG. 18, an air delivery nozzle 154 is inserted at least into the port 152, preferably through the port and into the bag 16 as shown. Then, air under pressure is flowed from an end orifice 156 in the air delivery nozzle 154 to expand the bag 16 substantially to its full volume.

Figure 19:
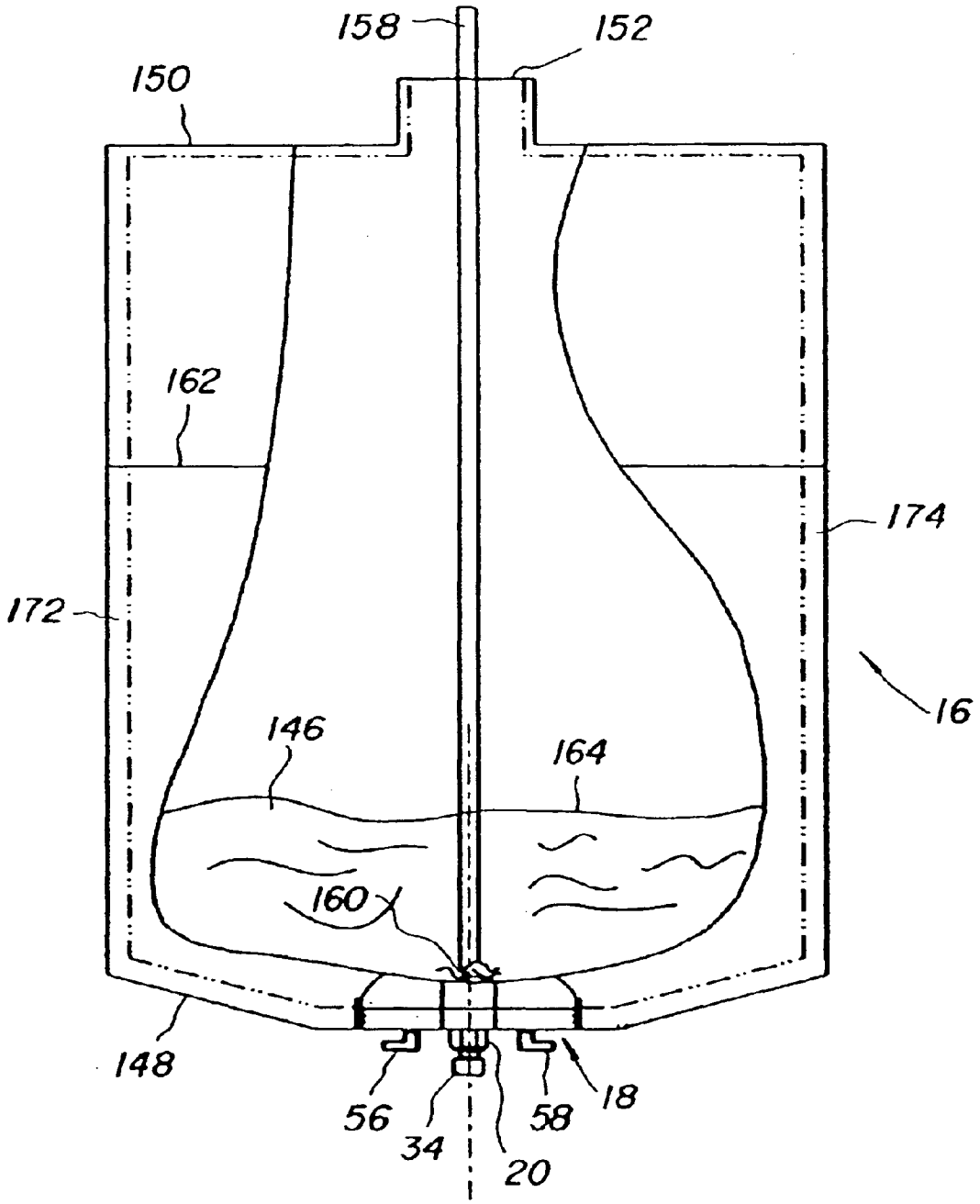
FIG. 19 is a plan view similar to FIG. 17, showing a liquid delivery nozzle filling the bag with a liquid ink.

In FIG. 19, the air delivery nozzle 154 is replaced in the port 152 with a liquid delivery nozzle 158. The liquid delivery nozzle 158 is inserted through the port 152 and into the bag 16 to position an end orifice 160 in that nozzle deep inside the bag as shown.

Then, in FIG. 19, the liquid ink 146 is flowed from the end orifice 160 in the liquid delivery nozzle 158 to fill the bag 16 up to a fill line 162. The fill line 162 is at 60%–75%, preferably 65%, of the full volume of the bag 16 in order to fill the bag to less than its capacity. The filling is done by flowing the liquid ink 146 from the end orifice 160 at an initial delivery velocity that is low enough to substantially prevent any bubbles from forming in the delivered liquid in the bag 16. After the liquid level 164 in the bag 16 rises to immerse at least the end orifice 160, the delivery velocity is increased to speed up the fill rate for the bag. This is done only until the bag 16 is filled to the predetermined percentage of its full volume.

Alternatively, the bag 16 can be filled with the liquid ink 146 to the predetermined percentage of its full volume in a vacuum environment so that air need not be forced into the bag to expand the bag substantially to its full volume before the bag is filled as in FIG. 18.

Figure 20:
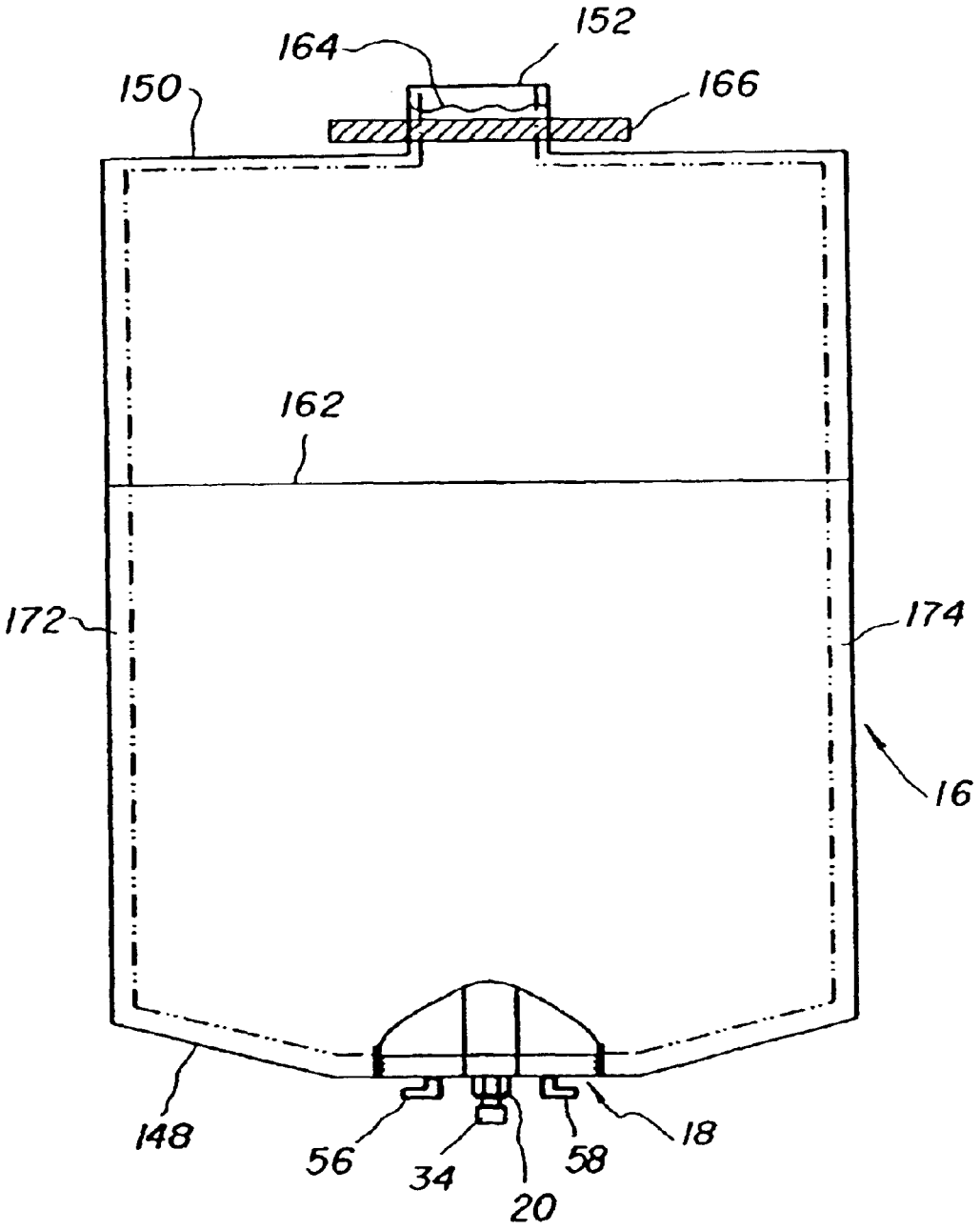
FIG. 20 is a plan view similar to FIG. 17, showing the bag filled to 65% of its capacity (its full volume) and being sealed.

In FIG. 20, the liquid delivery nozzle 158 is removed from the port 152, and any residual air that may be in the bag 16 is expelled through the port by squeezing the bag to raise the liquid level 164 in the bag at least into the port. (This need not be done if the bag 16 is filled with the liquid ink 146 to the predetermined percentage of its full volume in a vacuum environment.) Then, the bag 16, which is now partially collapsed to conform substantially to the volume of the liquid ink 146 in the bag, is sealed at or near the port 152, preferably using a pair of known heat-clamps or beat-sealing jaws 166 (only front heat-clamp shown) to heat seal the port, and then using a cold-clamp (not shown) to uniformly cool the resulting seal.

Method of Folding Bag 16 Filled With Liquid Ink 146 to Fit in Cartridge Housing 12, 14

The bag 16 is larger than the cartridge housing 12, 14 as can be seen in FIG. 1. Specifically, as depicted in FIG. 17, the bag 16 has a width 168 that is greater than a width of the cartridge housing 12, 14 and has a length 170 that is less than a length of the cartridge housing. This allows the bag 16 to be folded widthwise to fit in the cartridge housing 12, 14.

Figure 21:
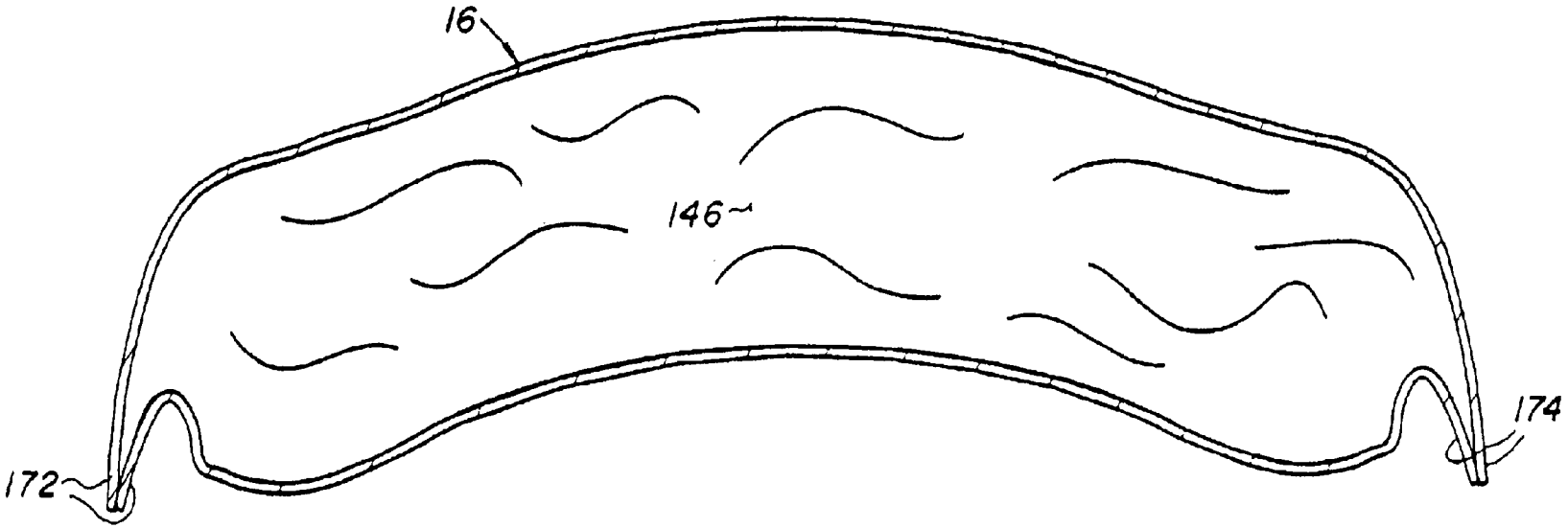
FIG. 21 is a section view of the bag collapsed to 65% of its capacity and folded about 90° at opposite longitudinal edge portions.
Figure 22:
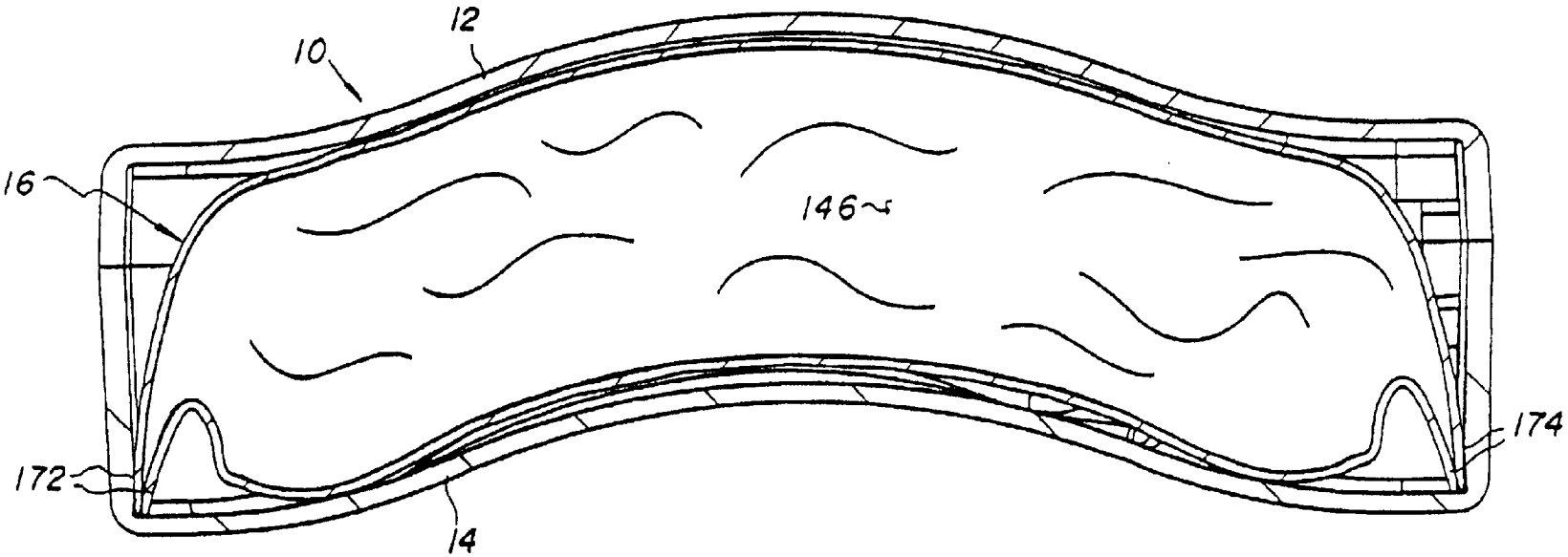
FIG. 22 is a section view of the housing halves connected together and containing the bag as shown in FIG. 21.

When the bag 146 is filled with the liquid ink 146 to the predetermined percentage of its full volume, and is partially collapsed to conform substantially to the volume of the liquid ink 146 in the bag and sealed at or near the port 152, it is then folded widthwise as shown in FIG. 21 and placed in the housing half 14.

As folded in FIG. 21, the bag 146 can substantially fit in the cartridge housing 12, 14 when the housing halves 12 and 14 are connected together. See FIG. 22.

The bag 16 is folded widthwise along two opposite longitudinal edge portions 172 and 174 from a longitudinal center portion 176 between the longitudinal edge portions. See FIGS. 17 and 21. The longitudinal edge portions 172 and 174 are each folded about 85°–95°, preferably 90° as shown in FIG. 21.

The longitudinal edge portions 172 and 174 each have a width 178 that is about 2%–5%, preferably 3%, of the width 168 of the bag 16. The longitudinal center portion 176 has a width 180 that is about 97% of the width 168 of the bag 16.

Since the bag 16 as folded has been filled with the liquid ink 146 to only a predetermined percentage of its full volume, the bag should not rupture if the cartridge housing 12, 14 is mechanically shocked, such as by dropping the cartridge housing onto a hard surface.

Another Method of Filling Bag 16

Figure 23:
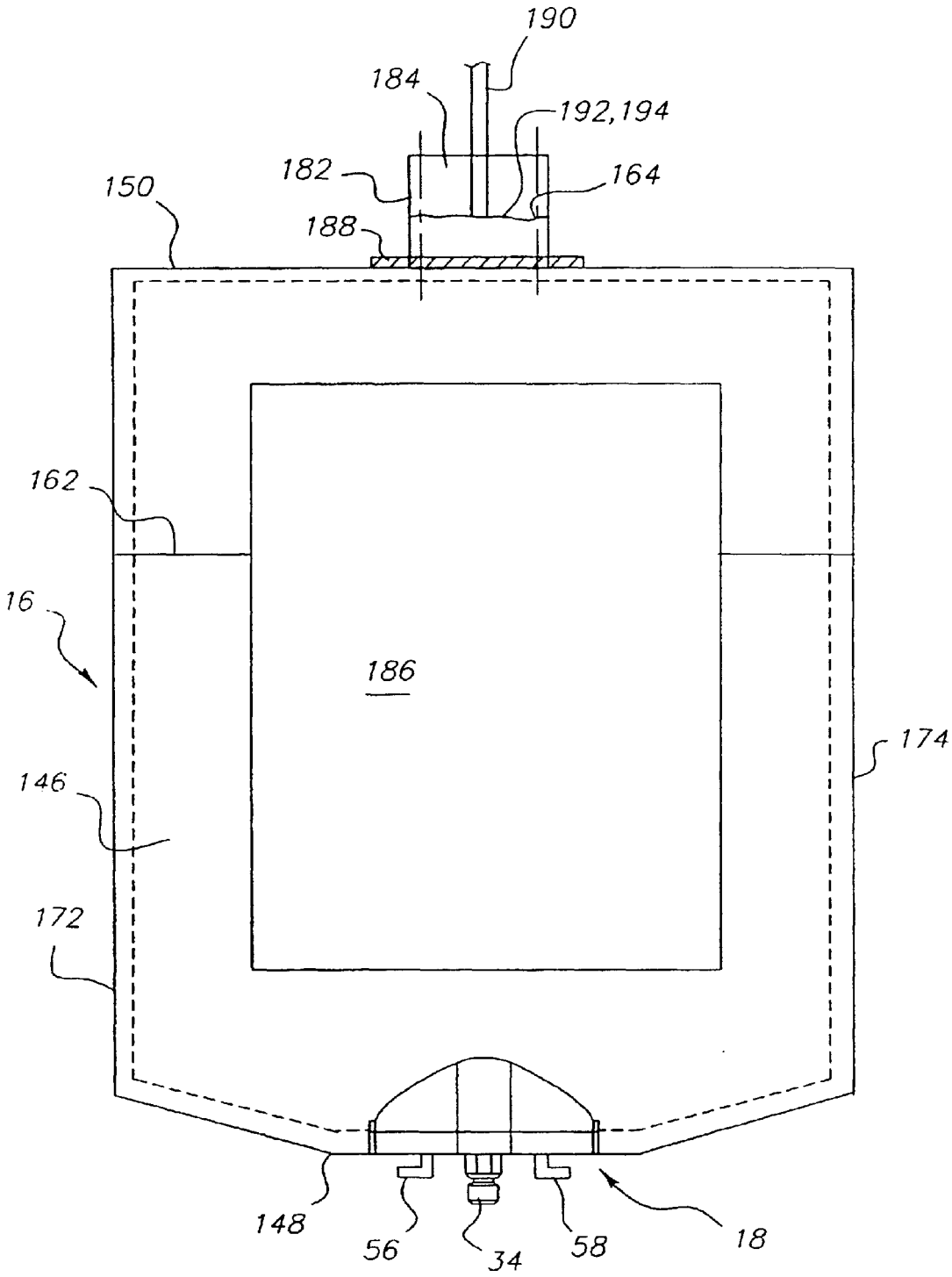
FIGS. 23–25 are plan views of the bag bottom end down and top end up as in FIG. 17, illustrating a method of filling the bag according to a preferred embodiment of the claimed invention.
Figure 24:
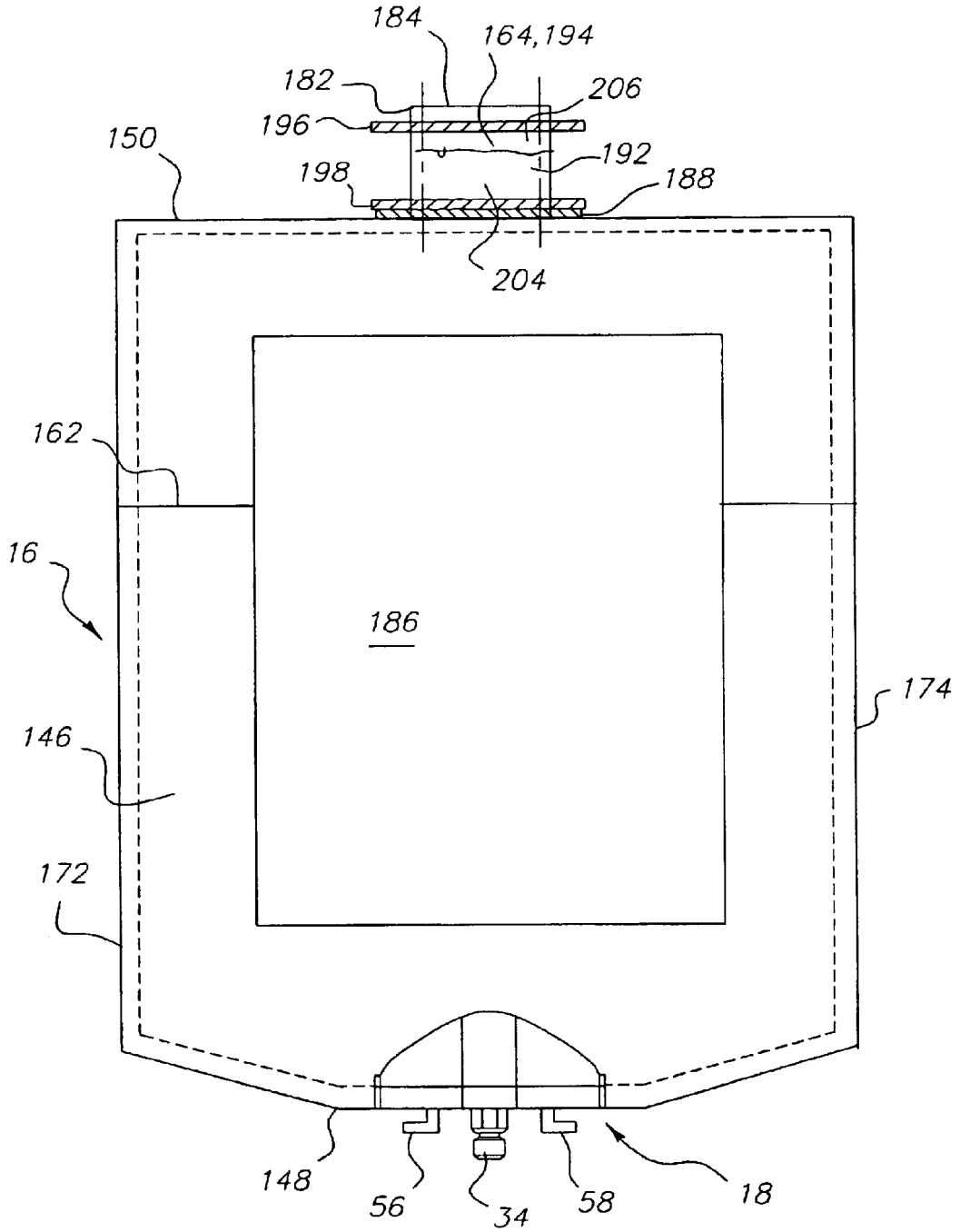
Figure 25:
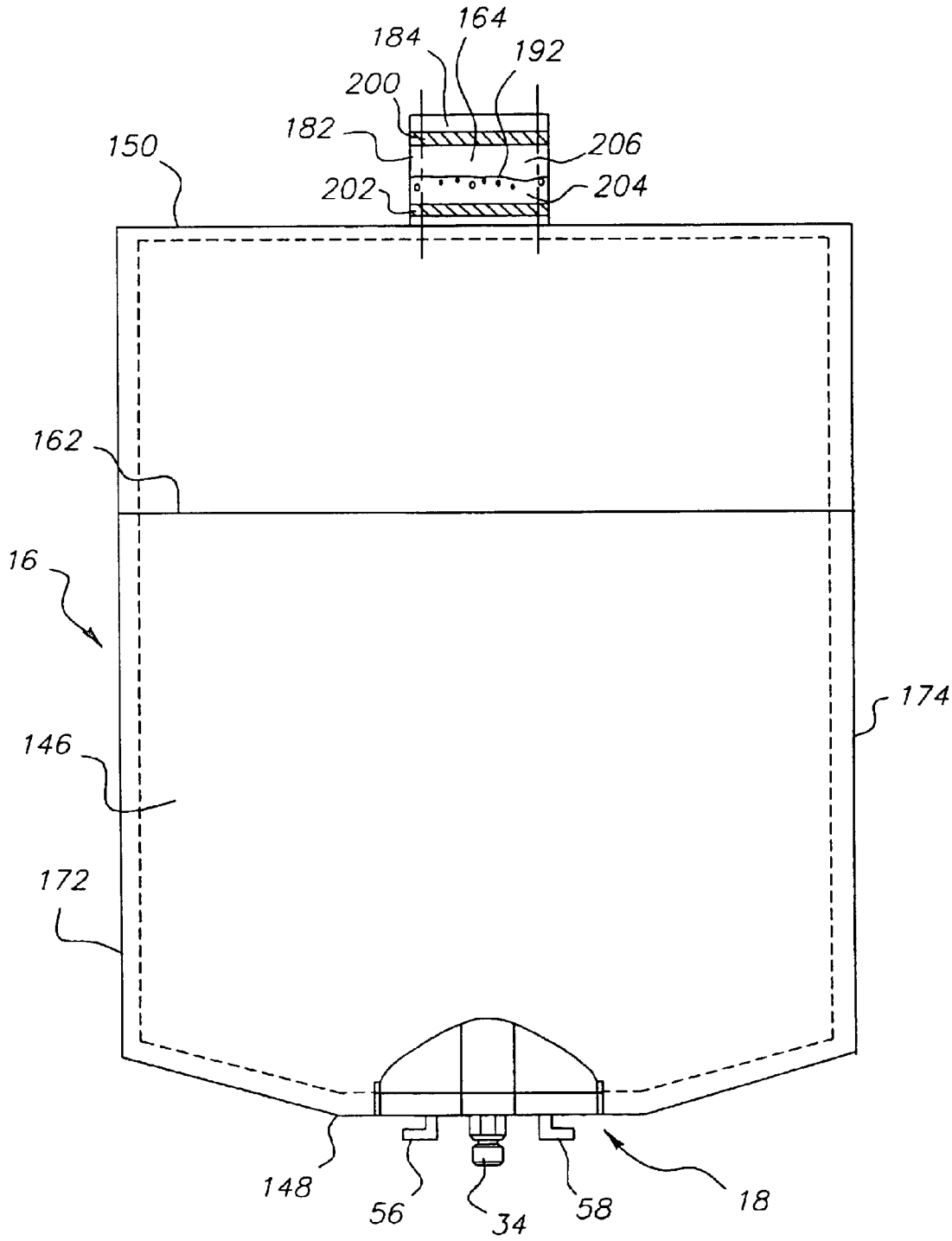

Another method of filling the bag 16 with the liquid ink 146 is shown in FIGS. 23–25. This method is a preferred embodiment of the claimed invention.

In FIGS. 23–25, the bag 16 is positioned vertically or erect with the bottom end 148 down and the top end 150 up. Instead of the intake/exhaust port 152 at the top end 150, the bag 16 has a longitudinal upper portion or throat 182 including an opening 184 which faces upward. Conversely, the fitting 18 that is attached to the bag 16, including the snout 20 with the septum and the cap 34, faces downward.

Beginning with FIG. 23, the liquid ink 146 has previously been flowed into the bag 16 through the opening 184 in the upper portion 182 to fill the bag to the fill line 162. When the liquid level 164 in the bag 16 is at the fill line 162, it is substantially below the upper portion 182. In FIG. 23, the bag 16 is squeezed or compressed by a known pair of parallel front and rear press plates 186 (only front press plate shown) and the upper portion 182 is squeezed or partially constricted by a pair of front and rear press bars 188 (only front press bar shown). This squeezing of the bag 16 including its upper portion 182 by the press plates 186 and the press bars 188 raises the liquid level 164 in the bag 16 partway into the upper portion as shown in FIG. 23. A known liquid sensor 190 is inserted partway into the upper portion 182 to sense when the liquid level 164 is raised partway into the upper portion.

While the bag is 16 is squeezed by the press plates 186 and the upper portion 182 is squeezed by the press bars 188, the bag (including the upper portion) is shaken or vibrated to cause any bubbles 192 in the liquid ink 146 in the bag to rise at least substantially to the liquid surface 194 at the liquid level 164 in the upper portion 182. See FIG. 23.

Next, in FIG. 24, the liquid sensor 190 is removed from the upper portion 182. Then, upper and lower pairs of known heat-clamps or heat-sealing jaws 196 and 198 (only front heat-clamps shown) are applied to the upper portion 182, above and below the liquid level 164 in the upper portion, to heat seal the upper portion at respective spaced upper and lower seals 200 and 202. See FIG. 25. This slightly raises the liquid level 164 in the upper portion 182, and traps a small quantity 204 of liquid ink that includes the bubbles 192 and a small quantity 206 of air between the upper and lower seals 200 and 202.

The upper and lower pairs of heat-clamps 196 and 198 may be applied simultaneously to the upper portion 182. Alternatively, the lower heat-clamp 198 may be applied first, followed by the lower heat-clamp 196.

Next, the bag is 16 is released from being squeezed by the press plates 186 and the upper portion 182 is released from being squeezed by the press bars 188. Then, the upper and lower pairs of heat-clamps 196 and 198 are removed from the upper portion 182, and in their place upper and lower pairs of cold-clamps (not shown) can be temporarily applied to uniformly cool the upper and lower seals 200 and 202.

The invention has been described in detail with particular reference to certain preferred embodiments thereof, but it will be understood that variations and modifications can be effected within the spirit and scope of the invention.

Parts List

10. ink cartridge
12. housing half
14. housing half
16. ink bag
18. connector-fitting
20. snout
22. collar
24. memory chip
26. elongate opening
28. ribs
30. septum
32. ink egress opening
34. cap
36. center opening
38. eight surfaces or facets
40. face
42. center opening
44. eight surfaces or facets
46. key slot
48. bottom wall portion
50. bottom wall portion
52. opening half
54. opening half
56. L-shaped engageable member
58. L-shaped engageable member
60. L-shaped engageable member
62. L-shaped engageable member
64. inner side
65. edge
66. groove
68. edge
70. pocket portion
72. pocket portion
74. wall opening portion
76. wall opening portion
78. sleeve or channel portion
80. sleeve or channel portion
82. inner side
84. ink blocking shield segment
86. ink blocking shield segment
88. stake
90. stake
92. tip
94. tip
96. cap
98. center opening
100. groove
102. clearance recess
104. clearance recess
106. clearance recess
108. clearance recess
110. lug
112. lug
114. cavity
116. cavity
118. protuberance
120. protuberance
122. protuberance
124. edge
126. cavity
128. edge
130. length
132. space
134. seam
136. tip
138. width
140. clearance space
142. flash
144. weld
146. liquid ink
148. bottom bag end
150. top bag end
152. intake/exhaust port
154. air delivery nozzle
156. end orifice
158. liquid delivery nozzle
160. end orifice
162. fill line
164. liquid level
166. heat-clamp
168. bag width
170. bag length
172. longitudinal edge portion
174. longitudinal edge portion
176. longitudinal center portion
178. longitudinal edge portion width
180. longitudinal center portion width
182. upper portion
184. opening
186. press plates
188. press bars
190. liquid sensor
192. bubbles
194. liquid surface
196. upper heat-clamps
198. lower heat-clamps
200. upper seal
202. lower seal
204. trapped small quantity of liquid ink
206. trapped small quantity of air

What is claimed is:

1. A method of filling an ink supply bag with a liquid ink, comprising:

positioning the bag bottom end down and a top end up;

flowing the liquid ink into the bag through an upper portion of the bag to fill the bag to a liquid level below the upper portion;

squeezing the bag to raise the liquid level in the bag partway into the upper portion, and shaking the bag to cause any bubbles in the liquid ink in the bag to rise at least substantially to the liquid surface in the upper portion; and sealing the upper portion above and below the liquid level in the upper portion to trap a small quantity of liquid ink that includes the bubbles and a small quantity of air between the respective seals.

2. A method as recited in claim 1, wherein the upper portion is sealed above and below the liquid level in the upper portion by heat-clamping the upper portion above and below the liquid level in the upper portion and then cold-clamping the upper portion at the same locations it has been heat-clamped.

3. A method as recited in claim 1, wherein a liquid sensor is inserted partway into the upper portion to sense when the liquid level in the bag is raised partway into the upper portion by squeezing the bag.

4. A method as recited in claim 1, wherein the upper portion is sealed above and below the liquid level in the upper portion simultaneously.

5. A method as recited in claim 1, wherein the upper portion is first sealed below the liquid level in the upper portion and then is sealed above the liquid level in the upper portion.

6. A method as recited in claim 1, wherein the upper portion is squeezed to partially constrict the upper portion when the bag is squeezed.

* * * * *